US010591830B2

(12) United States Patent
Matsushima et al.

(10) Patent No.: US 10,591,830 B2
(45) Date of Patent: Mar. 17, 2020

(54) IMAGE FORMING METHOD AND TONER SET FOR DEVELOPING ELECTROSTATIC LATENT IMAGE

(71) Applicant: Konica Minolta, Inc., Tokyo (JP)

(72) Inventors: Kaori Matsushima, Hino (JP); Tomoko Mine, Hino (JP); Hitomi Motani, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/128,612

(22) Filed: Sep. 12, 2018

(65) Prior Publication Data

US 2019/0094732 A1 Mar. 28, 2019

(30) Foreign Application Priority Data

Sep. 26, 2017 (JP) ..... 2017-185461

(51) Int. Cl.

| | |
|---|---|
| ***G03G 9/087*** | (2006.01) |
| ***G03G 9/097*** | (2006.01) |
| ***G03G 9/09*** | (2006.01) |
| ***G03G 15/01*** | (2006.01) |
| ***G03G 15/09*** | (2006.01) |
| *G03G 15/08* | (2006.01) |

(52) U.S. Cl.

CPC ..... *G03G 9/08755* (2013.01); *G03G 9/08711* (2013.01); *G03G 9/08782* (2013.01); *G03G 9/091* (2013.01); *G03G 9/0904* (2013.01); *G03G 9/0918* (2013.01); *G03G 9/09708* (2013.01); *G03G 9/09716* (2013.01); *G03G 9/09725* (2013.01); *G03G 15/0121* (2013.01); *G03G 15/08* (2013.01); *G03G 15/09* (2013.01)

(58) Field of Classification Search

CPC .... G03G 9/08755; G03G 9/091; G03G 15/08; G03G 9/0904; G03G 9/0918; G03G 9/08711; G03G 15/0121

See application file for complete search history.

(56) References Cited

U.S. PATENT DOCUMENTS

| | | | | |
|---|---|---|---|---|
| 2003/0087169 | A1 | 5/2003 | Uchinokura | |
| 2012/0288299 | A1 | 11/2012 | Uchinokura | |
| 2015/0044601 | A1* | 2/2015 | Taguchi ..... | G03G 9/0819 430/105 |

FOREIGN PATENT DOCUMENTS

| | | | |
|---|---|---|---|
| JP | 2001117277 | A | 4/2001 |
| JP | 2012234103 | A | 11/2012 |

* cited by examiner

*Primary Examiner* — Thorl Chea

(74) *Attorney, Agent, or Firm* — Lucas & Mercanti, LLP

(57) ABSTRACT

In an image forming method, a black toner and a color toner other than the black toner are used. The black toner and the color toner each include a binder resin including a polyester resin as a main component and a vinyl resin, a releasing agent, and an external additive. A content Vk % by mass of the vinyl resin relative to total mass of the binder resin included in the black toner, a content Vc % by mass of the vinyl resin relative to total mass of the binder resin included in the color toner, a content Wk % by mass of the releasing agent relative to the total mass of the binder resin included in the black toner, and a content Wc % by mass of the releasing agent relative to the total mass of the binder resin included in the color toner satisfy a specific relationship.

5 Claims, 1 Drawing Sheet

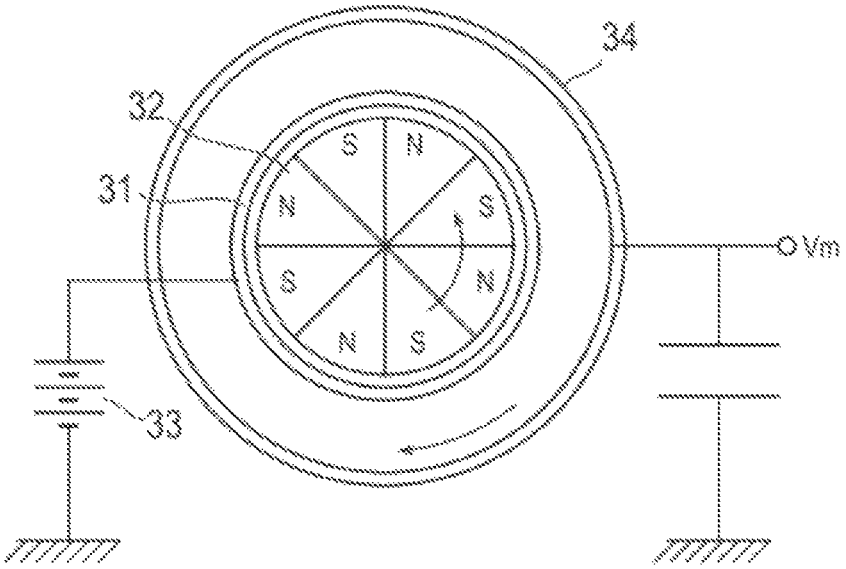
34
32
31
33
S
N
N
S
S
N
N
S
Vm

IMAGE FORMING METHOD AND TONER SET FOR DEVELOPING ELECTROSTATIC LATENT IMAGE

CROSS-REFERENCE TO RELATED APPLICATION

The entire disclosure of Japanese Patent Application No. 2017-185461, filed on Sep. 26, 2017, is incorporated herein by reference in its entirety.

BACKGROUND

1. Technological Field

The present invention relates to an image forming method and a toner set for developing an electrostatic latent image.

2. Description of Related Art

A color copying machine and a color printer using electrophotographic technology have been widely used. A feature of this technique is that the content of a binder resin is large relative to the total amount of a toner corresponding to printing ink. Specifically, the binder resin is included in an amount of 50% by mass or more, and preferably 80% by mass or more relative to the total amount of the toner. Therefore, when an image is formed on a medium such as paper, film, or the like, by using the toner, gloss according to a surface condition thereof is shown depending on thermal melting characteristic of the binder resin or elastic recovery characteristic at cooling of the binder resin.

Meanwhile, in recent years, colorization of a printed material has progressed, and images are often formed by toners of a plurality of colors. In this case, visual performance of the image varies depending on whether glossiness of a color portion and glossiness of a black portion are adjusted to be equal to each other or to be different from each other. In particular, in an image in which characters and photographs/designs are mixed, it is preferable that the glossiness of black is low from the viewpoint of easiness of viewing the characters. Meanwhile, from the viewpoint of forming a clear and highly visually recognizable image, it is preferable that the photograph/design has a certain high gloss. Therefore, it is becoming increasingly important to balance the gloss in the images in which the characters and the photographs/designs are mixed, from the viewpoint of compatibility between ease of viewing and high image quality.

Therefore, Japanese Patent Application Laid-Open No. 2012-234103 (corresponding to US2012/288299A1) has suggested a technique for suppressing glossiness of a black portion by adjusting a black toner to be smaller than a color toner with respect to the amount of heat of melting from 50° C. to 100° C. at a first temperature rising in DSC. Japanese Patent Application Laid-Open No. 2001-117277 has suggested a technique to obtain an image with good gloss balance by adjusting the glossiness of the black portion of the image and the glossiness of the color portion of the image.

SUMMARY

However, the present inventors found that, in the technique disclosed in Japanese Patent Application Laid-Open No. 2012-234103 (corresponding to US2012/288299A1) and Japanese Patent Application Laid-Open No. 2001-117277, there is a problem in that image quality is reduced when printing is continuously performed in large quantities (at the time of continuous printing). In addition, as a result of further study, it was found that reduction of the image quality is caused by the fact that a charge amount of a color toner at the time of continuous printing is greatly reduced relative to a charge amount at an initial stage, a reduction of a charge amount of the color toner and a reduction of a charge amount of the black toner are largely different from each other.

Therefore, an object of the present invention is to provide a means capable of controlling glossiness of a black portion and a color portion to improve balance of gloss and reducing a difference between the color toner and the black toner with respect to the reduction of the charge amount at the time of continuous printing relative to the initial stage. Further, another object of the present invention is to provide a means capable of favorably maintaining an image quality at the time of continuous printing.

The present inventors conducted intensive studies in view of the above problems. As a result, the present inventors found that the above problem can be solved by the following image forming method, and completed the present invention.

In order to achieve at least one of the objects described above, according to an aspect of the present invention, an image forming method reflecting one aspect of the present invention is an image forming method using a black toner and a color toner other than the black toner, in which the black toner and the color toner each include a binder resin including a polyester resin as a main component and a vinyl resin, a releasing agent, and an external additive, and the following formula (1) and formula (2) are satisfied wherein Vk (unit: % by mass) is a content of the vinyl resin relative to total mass of the binder resin included in the black toner, Vc (unit: % by mass) is a content of the vinyl resin relative to total mass of the binder resin included in the color toner, Wk (unit: % by mass) is a content of the releasing agent relative to the total mass of the binder resin included in the black toner, and Wc (unit: % by mass) is a content of the releasing agent relative to the total mass of the binder resin included in the color toner is.

$$2<Vk-Vc<50 \quad (1)$$

$$2<Wc-Wk<10 \quad (2)$$

Further, the present inventors found that the above problems can be solved by the following toner set for developing an electrostatic latent image, and completed the present invention.

In order to achieve at least one of the objects described above, according to an aspect of the present invention, a toner set for developing an electrostatic latent image reflecting one aspect of the present invention is a toner set for developing an electrostatic latent image, including a black toner, and a color toner other than the black toner, in which the black toner and the color toner each include a binder resin including a polyester resin as a main component and a vinyl resin, a releasing agent, and an external additive, and the above described formula (1) and formula (2) are satisfied wherein Vk (unit: % by mass) is a content of the vinyl resin relative to total mass of the binder resin included in the black toner, Vc (unit: % by mass) is a content of the vinyl resin relative to total mass of the binder resin included in the color toner, Wk (unit: % by mass) is a content of the releasing agent relative to the total mass of the binder resin included in the black toner, and Wc (unit: % by mass) is a content of the releasing agent relative to the total mass of the binder resin included in the color toner.

BRIEF DESCRIPTION OF THE DRAWINGS

The advantages and features provided by one or more embodiments of the present invention may be more fully understood by the following detailed description and the accompanying drawings. It should be noted that the drawings are shown for illustrative purposes only and are not intended to define the scope of the present invention.

FIGURE is a schematic diagram for explaining a method for measuring a charge amount. In FIGURE, reference numeral 31 denotes a conductive sleeve, reference numeral 32 denotes a magnet roll, reference numeral 33 denotes a bias power supply, and reference numeral 34 denotes a cylindrical electrode.

DETAILED DESCRIPTION OF THE EMBODIMENTS

Hereinafter, one or more embodiments of the present invention will be described. However, the scope of the present invention is not limited to the disclosed embodiment(s).

A first embodiment of the present invention is directed to an image forming method using a black toner and a color toner (also referred to simply as a "color toner" in this description) other than the black toner. The black toner and the color toner each include a binder resin including a polyester resin as a main component and a vinyl resin, a releasing agent, and an external additive. In addition, in the image forming method according to the present embodiment, the following formula (1) and formula (2) are satisfied wherein Vk (unit: % by mass) is a content of the vinyl resin relative to the total mass of the binder resin included in the black toner, Vc (unit: % by mass) is a content of the vinyl resin relative to the total mass of the binder resin included in the color toner, Wk (unit: % by mass) is a content of the releasing agent relative to the total mass of the binder resin included in the black toner, and Wc (unit: % by mass) is a content of the releasing agent relative to the total mass of the binder resin included in the color toner:

$$2<Vk-Vc<50 \quad (1)$$

$$2<Wc-Wk<10 \quad (2)$$

In addition, another embodiment of the present invention is directed to a toner set for developing an electrostatic latent image including a black toner and a color toner other than the black toner. The black toner and the color toner each include a binder resin including a polyester resin as a main component and a vinyl resin, a releasing agent, and an external additive. In addition, in the toner set for developing an electrostatic latent image according to the present embodiment, the above described formula (1) and formula (2) are satisfied wherein Vk (unit: % by mass) is a content of the vinyl resin relative to the total mass of the binder resin included in the black toner, Vc (unit: % by mass) is a content of the vinyl resin relative to the total mass of the binder resin included in the color toner, Wk (unit: % by mass) is a content of the releasing agent relative to the total mass of the binder resin included in the black toner, and Wc (unit: % by mass) is a content of the releasing agent relative to the total mass of the binder resin included in the color toner.

Further, the term "toner set" as used herein refers to a toner combination that forms different image forming layers when transferred onto a recording medium.

According to the image forming method of the present invention, it is possible to improve the balance of gloss by suppressing the glossiness of the black portion and increasing the glossiness of the color portion. In addition, by suppressing the reduction in the charge amount of the color toner at the time of continuous printing, it is possible to reduce a difference between the color toner and the black toner with respect to the reduction of the charge amount at the time of continuous printing relative to the initial stage. Therefore, it is possible to favorably maintain image quality at the time of continuous printing. Further, by using the toner set for developing an electrostatic latent image according to the present invention, the same effect as described above can be obtained. Even though the mechanism by which the above effect can be obtained by the constitution of the present invention is unclear, it is considered as follows.

In the present invention, the content of the releasing agent Wk (unit: % by mass, also simply referred to as "Wk" in the present description) relative to the total mass of the binder resin included in the black toner is smaller than the content of the releasing agent Wc (unit: % by mass, also referred to simply as "Wc" in the present description) relative to the total mass of the binder resin included in the color toner (i.e., Wc>Wk). As a result, the amount of the releasing agent that oozes out to the image surface at the time of thermal fixation is smaller in the black toner as compared to the color toner, and thus the glossiness of the image (black portion) to be formed is suppressed. Meanwhile, in the color toner including a large amount of releasing agent, the amount of releasing agent that oozes out to the image surface at the time of thermal fixation is large, and thus the glossiness of an image (color portion) to be formed increases. Further, since the color toner is easily melted by heat due to a large amount of the releasing agent, an image having a smooth surface can be formed, and thus it can be considered that the glossiness increases. Therefore, by relatively decreasing the content of the releasing agent in the black toner relative to the color toner, the glossiness of the black portion can be relatively lower than that of the color portion.

Here, when the value of Wc−Wk is 10 or more, the difference in glossiness between the black portion and the color portion is extremely large, and when the value of Wc−Wk is 2 or less, the difference in glossiness between the black portion and the color portion is extremely small, and the image quality is deteriorated.

Therefore, by setting the value of Wc−Wk to be less than 10 as defined in the above formula (2), the difference in glossiness between the black portion and the color portion is not extremely large, and thus it is possible to form an image excellent in balance of gloss. Further, by setting the value of Wc−Wk to be larger than 2, the glossiness of the black portion is moderately suppressed, and the difference in glossiness between the black portion and the color portion is not excessively small, and thus it is possible to form an image excellent in balance of gloss.

Here, it is considered that an external additive present on a surface of toner base particles tends to be buried in an exposed portion of the releasing agent as compared to an exposed portion of the binder resin when mechanical stress is applied. In addition, the burying of the external additive reduces the charge amount. Therefore, generally, when Wc>Wk as described above, the releasing agent is more likely to be exposed on the surface of the toner base particles in the color toner as compared to the black toner. As a result, the charge amount tends to be reduced due to the burying of the external additive by mechanical stress during an external additive addition process (toner external addition production process), transport inside the machine, stirring inside the developing device, and the like. In addition, such a reduction in the charge amount is remarkable, in particular, in continuous printing, and thus when the reduction of the charge amount at the time of continuous printing relative to the initial charge amount is greatly different between the color toner and the black toner, degradation of image quality is caused.

For such a problem, in the present invention, it is also possible to suppress reduction of the charge amount of the color toner by controlling the content of the vinyl resin as follows.

In the present invention, the content of the vinyl resin Vc (unit: % by mass, also simply referred to as "Vc" in the present description) relative to the total mass of the binder resin included in the color toner is smaller than the content of the vinyl resin Vk (unit: % by mass, also simply referred to as "Vk" in the present description) relative to the total mass of the binder resin included in the black toner (i.e., Vk>Vc).

Here, it is presumed that the vinyl resin functions as a dispersant for the releasing agent. Therefore, in the color toner, since the content of the vinyl resin which disperses the releasing agent is smaller than the content of the vinyl resin in the black toner, the releasing agent tends to aggregate inside the toner base particles, and it is difficult for the releasing agent to be exposed on the surface of the toner base particles. Therefore, in the color toner, burying of the external additive due to mechanical stress is suppressed. As a result, even at the time of continuous printing, reduction in the charge amount of the color toner can be relatively suppressed. Meanwhile, although the content of the releasing agent is small in the black toner as compared to the color toner (Wc>Wk), the content of the vinyl resin which disperses the releasing agent is large. Therefore, in the base particles of the black toner, the releasing agent is sufficiently finely dispersed and is likely to be exposed on the surface of the toner base particles. As a result, in the black toner, the burying of the external additive is relatively easy to occur, thereby making it easier to lower the charge amount at the time of continuous printing.

Therefore, by relatively decreasing the content of the vinyl resin in the color toner relative to the black toner as described above, the charge amount of the black toner is lowered to some extent while reducing the reduction of the charge amount of the color toner at the time of continuous printing. As a result, it is possible to reduce the difference between the color toner and the black toner with respect to the reduction of the charge amount between the initial stage and the continuous printing.

Here, when the value of Vk−Vc is 50 or more, dispersibility of the releasing agent by the vinyl resin is extremely high in the black toner, and the amount of the releasing agent present on the surface of the toner base particles decreases. Therefore, the amount of the releasing agent that oozes out to the image surface at the time of thermal fixation decreases, and the glossiness of the black portion is excessively small. Therefore, the difference in glossiness between the black portion and the color portion is excessively large. In addition, when the value of Vk−Vc is 2 or less, dispersibility of the releasing agent by the vinyl resin in the color toner is enhanced, and the releasing agent is likely to be exposed on the surface of the toner base particles. As a result, burying of the external additive due to mechanical stress easily occurs. As a result, in the color toner, the reduction of the charge amount at the time of the continuous printing relative to the initial stage is large, and thus the difference in the reduction of the charge amount between the color toner and the black toner is large, and as a result, it is thought that the image quality at the time of continuous printing decreases.

Therefore, by setting the value of Wc−Wk to be less than 50 as defined in the above formula (1), it is possible to form an image in which the difference in glossiness between the black portion and the color portion may not be extremely large and the balance of gloss is excellent. Further, by setting the value of Vk−Vc to be larger than 2, it is possible to form an image with good image quality even at the time of continuous printing.

As described above, in the image forming method and the toner set for developing an electrostatic latent image according to the present invention, the content of the vinyl resin and the content of the releasing agent included in the black toner and the color toner other than the black toner have a specific relationship. Therefore, according to the present invention, it is possible to provide a means capable of controlling the glossiness of the black portion and the color portion to improve balance of gloss and reducing the difference between the color toner and the black toner with respect to the reduction of the charge amount at the time of continuous printing as compared to the initial stage. Therefore, the means capable of favorably maintaining the image quality at the time of continuous printing can also be provided.

Further, the above mechanism is based on assumption, and the present invention is not limited by the above mechanism at all.

Hereinafter, embodiments for practicing the present invention are described in detail. In addition, the present invention is not limited to embodiments below. Further, in the present description, "X to Y" indicating the range includes "X" and "Y" and means "X or more and Y or less". In addition, unless specifically stated otherwise, operation and measurement of physical properties, and the like, are performed under conditions of room temperature (25° C.)/relative humidity of 40 to 50% RH.

The image forming method (particularly, an electrophotographic image forming method) and the toner set for developing an electrostatic latent image according to the present invention are characterized for each toner as described above. Therefore, hereinafter, the constitution of each toner is firstly described in detail.

<Toner (Toner for Developing Electrostatic Latent Image)>

The black toner according to the present invention includes a binder resin including a polyester resin as a main component and a vinyl resin, a releasing agent, and an external additive. In addition, the color toner other than the black toner according to the present invention includes a binder resin including a polyester resin as a main component and a vinyl resin, a releasing agent, and an external additive. In the present description, "color toner other than black toner" means a colored toner (color toner) including a colorant other than a black type colorant as a colorant. In addition, the "toner" according to the present invention contains "toner base particles". The "toner base particle" after addition of an external additive is referred to as a "toner particle". "Toner" means an aggregate of "toner particles".

[Toner Particle]

The toner according to the present invention (hereinafter, referring to a black toner and a color toner other than black toner) includes a binder resin, a releasing agent and an external additive. The toner according to the present invention preferably includes toner particles having a structure in which an external additive adheres to a surface of the toner base particles including the binder resin and the releasing agent. Here, the toner base particles of the black toner may further include a black type colorant. Further, the toner base particles of the color toner may further include a colorant corresponding to each color of the color toner. Further, the toner base particles may contain other toner constituents such as a charge control agent, and the like, if necessary. Hereinafter, each component forming the toner (base) particles and the form of the toner (base) particles, and the like, are described.

<Vinyl Resin>

The binder resin included in the toner according to the present invention includes a vinyl resin. The vinyl resin is a resin obtained by polymerization using at least a vinyl monomer. Specific examples of the vinyl resin include an acrylic resin, a styrene acrylic copolymer resin (styrene acrylic resin), and the like.

Among them, the vinyl resin is preferably a styrene acrylic copolymer resin formed using a styrene monomer and a (meth)acrylic acid ester monomer. That is, it is preferable that the black toner and the color toner according to the present invention each include a styrene acrylic resin. The styrene acrylic resin is likely to contribute to dispersion of the releasing agent (particularly, hydrocarbon-based waxes). Accordingly, dispersibility of the releasing agent is improved and chargeability at the time of continuous printing is easily controlled, and thus the effect of the present invention is more easily obtained. In addition, the styrene acrylic resin is preferable since it is excellent in environmental stability of charge amount. Further, the vinyl resin may be used alone or in a combination of two or more kinds thereof.

As the vinyl monomer forming the vinyl resin, one or two or more selected from the following monomers can be used.

(1) Styrene Monomer

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives thereof, etc.

(2) (Meth)Acrylic Acid Ester Monomer

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, and derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others

Vinyl compounds such as vinyl naphthalene and vinyl pyridine, acrylic acid or methacrylic acid derivatives such as acrylonitrile, methacrylonitrile, acrylamide, etc.

Further, as the vinyl monomer, it is preferable to use a monomer having an ionic dissociation group, for example, a carboxyl group, a sulfonic acid group, a phosphoric acid group, or the like. Specific examples thereof are as follows.

Examples of the monomer having a carboxylic group may include acrylic acid, methacrylic acid, maleic acid, itaconic acid, cinnamic acid, fumaric acid, maleic acid monoalkyl ester, itaconic acid monoalkyl ester, and the like. Further, examples of the monomer having a sulfonic acid group may include styrene sulfonic acid, allyl sulfosuccinic acid, 2-acrylamide-2-methylpropanesulfonic acid, and the like. In addition, examples of the monomer having a phosphoric acid group may include acidphosphoxyethyl methacrylate, and the like.

Further, a vinyl resin having a cross-linked structure which is obtained by using polyfunctional vinyls as the vinyl monomer may be used. Examples of the polyfunctional vinyls may include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

A production method of the vinyl resin is not particularly limited, and may include methods in which polymerization is performed by a known polymerization method such as bulk polymerization, solution polymerization, an emulsion polymerization method, a mini-emulsion method, a dispersion polymerization method, or the like, by using any polymerization initiator such as a peroxide, a persulfate, a persulfide, an azo compound, or the like, which is generally used for polymerization of the above monomer. In addition, for the purpose of adjusting the molecular weight, a commonly used chain transfer agents can be used. The chain transfer agent is not particularly limited, and examples thereof may include alkyl mercaptan, mercapto fatty acid ester, and the like.

Further, a molecular weight measured by gel permeation chromatography (GPC) of the vinyl resin is preferably 10,000 to 100,000 in weight average molecular weight (Mw).

In the present invention, the content of the vinyl resin included in the black toner and the color toner is not particularly limited as long as it satisfies the above formula (1). That is, it is sufficient that the value of Vk−Vc is more than 2 and less than 50. Therefore, by satisfying this relationship, it is possible to control the glossiness of the black portion and the color portion to improve balance of gloss and to reduce a difference between the color toner and the black toner with respect to the reduction of the charge amount at the time of continuous printing as compared to the initial stage. Therefore, it is possible to favorably maintain the image quality at the time of continuous printing. Here, the Vk (unit: % by mass) is a content (content ratio) of the vinyl resin relative to the total mass of the binder resin included in the black toner and the Vc is a content (content ratio) of the vinyl resin relative to the total mass of the binder resin included in the color toner. Further, when two or more color toners are used, Vc is the content (content ratio) of the vinyl resin relative to the total mass of the binder resin included in each color toner of each color. Therefore, Vc is a value defined for the color toner of each color. Further, in the case where two or more color toners are used, when at least one color toner satisfies the above formula (1), it is determined that the image forming method satisfies the above formula (1). However, from the viewpoint of appropriately controlling the glossiness of the color portion to improve the balance of gloss, and further favorably maintaining the image quality at the time of the continuous printing, it is preferable that all of the color toners used in the image forming method satisfy the above formula (1).

Further, from the similar viewpoint, it is more preferable that all of the color toners satisfy Formula (3) described below.

From the viewpoint of improving the balance of the gloss of the black portion and the color portion and favorably maintaining the image quality at the time of the continuous printing, the value of Vk−Vc is preferably more than 5, and more preferably more than 10. In addition, from the similar viewpoint, the value of Vk−Vc is preferably less than 40, and more preferably less than 30. Further, it is particularly preferable that the values of Vk and Vc satisfy the following Formula (3). When the following Formula (3) is satisfied, the balance between the gloss of the black portion and the color portion is improved, and the image quality at the time of the continuous printing is improved.

$$10<Vk-Vc<30 \quad (3)$$

From the viewpoint of excellent dispersibility of the releasing agent and easiness of controlling the chargeability at the time of the continuous printing, the content (content ratio) of the vinyl resin relative to the total mass of the binder resin in the black toner is preferably 20 to 50% by mass, and more preferably 30 to 50% by mass. In addition, in the color toner, the content (content ratio) of the vinyl resin relative to the total mass of the binder resin is preferably more than 0% by mass and 40% by mass or less, more preferably more than 0% by mass and less than 40% by mass, and particularly preferably 10 to 30% by mass.

The above-described Vk and Vc can be measured by on-line analysis using pyrolysis GC/MS of the toner base particles, or by other instrumental analysis, or the like. An example of pyrolysis GC/MS measurement conditions in the on-line analysis is shown below;

Equipment; Frontier Laboratories Ltd., PY-2020iD/Shimadzu GC/MS QP2010

Column; UA-5(MS/HT) 0.25 mm id×30 m, 0.25 μm

Data processing quantitative calculation method: Absolute calibration curve method or standard addition method.

Further, in the case of other instrumental analysis, pretreatment for extracting the binder resin with an appropriate solvent (for example, THF, MEK, chloroform, etc.) is performed, and then Vk and Vc can be measured using methods such as pyrolysis GC/MS, pyrolysis GC using a FID detector, $^1$HNMR, IR, or the like. Here, the extraction method in the pretreatment is not particularly limited, but known methods such as Soxhlet extraction, heating at reflux, ultrasonic irradiation, and the like, can be appropriately employed.

<Polyester Resin>

The binder resin included in the toner according to the present invention includes a polyester resin. The polyester resin constitutes a binder resin together with the above vinyl resin, and is a main component of a binder resin included in toner base particles. By using the polyester resin as a main component, compatibility between the polyester resin and the releasing agent and dispersibility of the releasing agent by the vinyl resin included in the binder resin are easily controlled. In the present description, the "main component" means a resin having a content ratio of 50% by mass or more relative to the total amount of the binder resin. Further, the main component is preferably a resin having the highest content ratio in the binder resin. The content of the polyester resin (in the case where the polyester resin includes an amorphous polyester resin and a crystalline polyester resin as described below, the total amount the amorphous polyester resin and the crystalline polyester resin) is preferably 50 to 85% by mass, and more preferably 60 to 80% by mass relative to the total mass of the binder resin.

The polyester resin is a resin obtained by a polycondensation reaction of a divalent or higher carboxylic acid (polyvalent carboxylic acid) and a dihydric or higher alcohol (polyhydric alcohol). The polyester resin is roughly classified into an amorphous polyester resin and a crystalline polyester resin depending on its properties. Therefore, when the binder resin includes both the amorphous polyester resin and the crystalline polyester resin, the content of the polyester resin means the total amount of the amorphous polyester resin and the crystalline polyester resin. Hereinafter, the amorphous polyester resin and the crystalline polyester resin are described.

(Amorphous Polyester Resin)

The amorphous polyester resin is a polyester resin, which has no melting point and a relatively high glass transition temperature (Tg) when differential scanning calorimetry (DSC) is performed. Here, the glass transition temperature (Tg) is preferably from 30 to 80° C., and particularly preferably 40 to 64° C. Further, the glass transition temperature (Tg) can be measured by differential calorimetry (DSC), and specifically, it is measured by the method described in Examples. Further, since the monomer constituting the amorphous polyester resin is different from the monomer constituting the crystalline polyester resin, the monomer constituting the amorphous polyester resin can be distinguished from the amorphous polyester resin by, for example, NMR analysis, or the like. In addition, those skilled in the art can control the glass transition temperature (Tg) depending on the composition of the resin.

From the viewpoint that the plasticity is easily controlled and the glossiness is more easily to be controlled, it is preferable that the binder resin included in the toner base particles includes an amorphous polyester resin as a main component.

There is no particular limitation on the amorphous polyester resin, and conventionally known amorphous polyester resins in the technical field may be used. As the amorphous polyester resin, a commercially available product may be used, or a synthesized product may be used. Examples of the polyvalent carboxylic acid and the polyhydric alcohol used for producing the amorphous polyester resin are not particularly limited, and may include the following materials.

(1) Polyvalent Carboxylic Acid

As the polyvalent carboxylic acid, it is preferable to use an unsaturated aliphatic polyvalent carboxylic acid, an aromatic polyvalent carboxylic acid, or derivatives thereof. A saturated aliphatic polyvalent carboxylic acid may be used in combination as long as an amorphous resin can be formed.

Examples of the unsaturated aliphatic polyvalent carboxylic acid may include unsaturated aliphatic dicarboxylic acids such as methylene succinic acid, fumaric acid, maleic acid, itaconic acid, citraconic acid, glutaconic acid, isododecenylsuccinic acid, dodecenylsuccinic acid, octenylsuccinic acid, and the like; unsaturated aliphatic tricarboxylic acids such as 3-butene-1,2,3-tricarboxylic acid, 4-pentene-1,2,4-tricarboxylic acid, aconitic acid, and the like; unsaturated aliphatic tetracarboxylic acids such as 4-pentene-1,2,3,4-tetracarboxylic acid, and the like. In addition, lower alkyl esters and acid anhydrides thereof can also be used.

Examples of the aromatic polyvalent carboxylic acid may include aromatic dicarboxylic acids such as phthalic acid, terephthalic acid, isophthalic acid, t-butylisophthalic acid, tetrachlorophthalic acid, chlorophthalic acid, nitrophthalic acid, p-phenylene diacetic acid, 2,6-naphthalenedicarboxylic acid, 4,4'-biphenyldicarboxylic acid, anthracenedicarboxylic acid, and the like; aromatic tricarboxylic acids such as 1,2,4-benzenetricarboxylic acid (trimellitic acid), 1,2,5-benzenetricarboxylic acid (trimesic acid), 1,2,4-naphthalenetricarboxylic acid, hemimellitic acid, and the like; aromatic tetracarboxylic acids such as pyromellitic acid, 1,2,3,4-butanetetracarboxylic acid, and the like; aromatic hexacarboxylic acids such as mellitic acid, and the like. In addition, lower alkyl esters and acid anhydrides thereof can also be used.

The polyvalent carboxylic acid may be used alone or in a combination of two or more kinds thereof.

(2) Polyhydric Alcohol

From the viewpoints of chargeability and toner strength, as the polyhydric alcohol, it is preferable to use an unsaturated aliphatic polyhydric alcohol, an aromatic polyhydric alcohol or derivatives thereof. A saturated aliphatic polyhydric alcohol may be used in combination as long as an amorphous resin can be formed.

Examples of the unsaturated aliphatic polyhydric alcohol may include unsaturated aliphatic diols such as 2-butene-1,4-diol, 3-butene-1,4-diol, 2-butyne-1,4-diol, 3-butyne-1,4-diol, 9-octadecene-7,12-diol, and the like, and derivatives thereof may also be used.

Examples of the aromatic polyhydric alcohol may include bisphenols such as bisphenol A and bisphenol F, and the like, alkylene oxide adducts of bisphenols such as ethylene oxide adducts and propylene oxide adducts thereof, 1,3,5-benzene triol, 1,2,4-benzenetriol, 1,3,5-trihydroxymethylbenzene, and the like, and derivatives thereof may also be used. Among them, in particular, from the viewpoint that it is easy to optimize thermal characteristics, it is preferable to use bisphenol A compounds such as ethylene oxide adduct and propylene oxide adduct of bisphenol A.

The polyhydric alcohol may be used alone or in a combination of two or more kinds thereof.

A production method of the amorphous polyester resin is not particularly limited, and the resin may be produced by polycondensation (esterification) of the polyvalent carboxylic acid and the polyhydric alcohol using a known esterification catalyst.

Examples of the catalyst that can be used in the production may include alkali metal compounds such as sodium, lithium, and the like; compounds including Group 2 elements such as magnesium, calcium, and the like; metal compounds including aluminum, zinc, manganese, antimony, titanium, tin, zirconium, germanium, and the like; a phosphorous acid compound; a phosphoric acid compound; and an amine compound, and the like. When considering easiness of acquisition, and the like, it is preferable to use dibutyl tin oxide, tin octylate, tin dioctylate, salts thereof, tetra-n-butyl titanate (tetrabutyl orthotitanate), tetraisopropyl titanate (titanium tetraisopropoxide), tetramethyl titanate, and the like. These catalysts may be used alone or in a combination of two or more kinds thereof.

The temperature of polycondensation (esterification) is not particularly limited, but preferably 150 to 250° C. Further, the time of polycondensation (esterification) is not particularly limited, but preferably 0.5 to 15 hours. During polycondensation, the inside of a reaction system may be reduced in pressure if necessary.

A weight average molecular weight (Mw) of the amorphous polyester resin is not particularly limited, but preferably within the range of 5,000 to 100,000, and more preferably within the range of 5,000 to 50,000. The weight average molecular weight (Mw) can be measured by gel permeation chromatography (GPC), and specifically by the method described in Examples. When the weight average molecular weight is 5,000 or more, a thermal resistant storage property of the toner can be improved, and when the weight average molecular weight is 100,000 or less, the low temperature fixability can be further improved.

In the present invention, the content of the amorphous polyester resin included in the black toner and the color toner is preferably from 25 to 70% by mass, and more preferably from 30 to 60% by mass relative to the total mass of the binder resin. When the content of the amorphous polyester resin is 25% by mass or more, plasticization is facilitated, and thus it is easier to control the glossiness. Meanwhile, when the content of the amorphous polyester resin is 70% by mass or less, it is easy to control the dispersibility of the releasing agent by the vinyl resin included in the binder resin. As a result, it is easy to control burying of the external additive due to mechanical stress, and thus it is easy to control the chargeability at the time of continuous printing.

(Crystalline Polyester Resin)

The crystalline polyester resin is a polyester resin, which has a clear endothermic peak, rather than a stepwise endothermic change in measurement of differential scanning calorimetry (DSC). The clear endothermic peak means an endothermic peak with a half-value width of 15° C. or less in the differential scanning calorimetry (DSC) when the measurement is performed at a temperature rising rate of 10° C./min.

A melting point (Tm) of the crystalline polyester resin is preferably 55 to 90° C., and more preferably 65 to 88° C. If the melting point of the crystalline polyester resin is in the range of 55 to 90° C., sufficient low temperature fixability can be obtained. Further, the melting point (Tm) of the crystalline polyester resin can be measured by differential calorimetry (DSC), and specifically by the method described in Examples. In addition, those skilled in the art can control the melting point (Tm) depending on the composition of the resin.

As described below, it is preferable that the binder resin further includes a crystalline resin, particularly a crystalline polyester resin, from the viewpoint of improving low temperature fixability of the toner, and the like. It is easy to control the reduction of the charge amount at the time of the continuous printing by including the crystalline polyester resin, and thus the image quality at the time of the continuous printing can be further improved.

There is no particular limitation on the crystalline polyester resin, and conventionally known crystalline polyester resins in the technical field may be used. As the crystalline polyester resin, a commercially available product may be used, or a synthesized product may be used. Examples of the polyvalent carboxylic acid and the polyhydric alcohol used for producing the crystalline polyester resin are not particularly limited, and can include the following materials.

(1) Polyvalent Carboxylic Acid

As the polyvalent carboxylic acid, it is preferable to use a saturated aliphatic polyvalent carboxylic acid, an alicyclic polyvalent carboxylic acid or derivatives thereof.

Examples of the saturated aliphatic polyvalent carboxylic acid may include saturated aliphatic dicarboxylic acids such as oxalic acid, malonic acid, succinic acid, adipic acid, pimelic acid, sebacic acid, azelaic acid, n-dodecylsuccinic acid, 1,9-nonanedicarboxylic acid, 1,10-decanedicarboxylic acid (dodecanedioic acid), 1,11-undecane dicarboxylic acid, 1,12-dodecane dicarboxylic acid, 1,13-tridecane dicarboxylic acid, 1,14-tetradecane dicarboxylic acid, and the like; alicyclic dicarboxylic acids such as cyclohexane dicarboxylic acid, and the like. In addition, polyvalent carboxylic acids other than a divalent carboxylic acid may be used. In addition, lower alkyl esters and acid anhydrides thereof can also be used.

The polyvalent carboxylic acid may be used alone or in a combination of two or more kinds thereof.

(2) Polyhydric Alcohol

Examples of the polyhydric alcohol may include aliphatic diols such as ethylene glycol, 1,2-propanediol, 1,3-propanediol, 1,4-butanediol, 1,5-pentanediol, 1,6-hexanediol, 1,7-hetanediol, 1,8-octanediol, 1,9-nonanediol, 1,10-decanediol, 1,12-dodecanediol, neopentyl glycol and 1,4-butenediol, and the like; trihydric or higher polyhydric alcohols such as glycerin, pentaerythritol, trimethylolpropane, sorbitol and the like, and derivatives thereof.

The polyhydric alcohol may be used alone, or two or more kinds thereof may be used in combination. Further, the polyhydric alcohol may have some branching or crosslinking depending on selection of the valency of the polyvalent carboxylic acid and the valence of the polyhydric alcohol, or the like.

A production method of the crystalline polyester resin is not particularly limited, and the resin may be formed by polycondensation (esterification) of the polyvalent carboxylic acid and the polyhydric alcohol using a known esterification catalyst. Specifically, the catalyst and polycondensation conditions described in the part of (Amorphous polyester resin) can be applied.

The number average molecular weight (Mn) of the crystalline polyester resin is not particularly limited, but is preferably within the range of 1,500 to 25,000, and more preferably within the range of 3,000 to 20,000. Within this range, the low temperature fixability may be further improved. The number average molecular weight (Mn) can be measured by gel permeation chromatography (GPC), and specifically, by the method described in Examples.

In the present invention, the content of the crystalline polyester resin included in the black toner and the color toner is not particularly limited, but preferably 8 to 30% by mass, and more preferably 10 to 25% by mass relative to the total mass of the binder resin. When the content of the crystalline polyester resin is 8% by mass or more, appropriate plasticization progresses by compatibility with the vinyl resin or the amorphous polyester resin, and thus it is easy to exhibit an effect of low temperature fixability. Meanwhile, when the content of the crystalline polyester resin is 30% by mass or less, it is possible to suppress deterioration of the chargeability due to the crystalline polyester resin. In addition, since plasticization is appropriately suppressed, offset in a high-temperature fixation region is suppressed.

In addition, a mass ratio of the crystalline polyester resin and the amorphous polyester resin is not particularly limited, but the amorphous polyester resin/crystalline polyester resin (mass ratio) is preferably 50/50 to 90/10, and more preferably 60/40 to 80/20.

In addition, the binder resin may contain other amorphous resins other than the vinyl resin and the amorphous polyester resin. The content of the other amorphous resin is preferably 30% by mass or less relative to the total mass of the binder resin, and more preferably 0% by mass, that is, more preferably, the binder resin does not contain other amorphous resin.

<Crystalline Resin>

The binder resin included in the toner according to the present invention preferably further includes a crystalline resin. By further including the crystalline resin, these resins are compatible with each other at the time of thermal fixation, and thus the low temperature fixability can be improved. In addition, it is easy to control chargeability.

The crystalline resin is a resin, which has a clear endothermic peak, rather than a stepwise endothermic change in differential scanning calorimetry (DSC). The clear endothermic peak means an endothermic peak with a half-value width of 15° C. or less in the differential scanning calorimetry (DSC) when the measurement is performed at a temperature rising rate of 10° C./min. A melting point (Tm) of the crystalline resin is preferably 55 to 90° C., and more preferably 65 to 88° C. If the melting point of the crystalline resin is in the range of 55 to 90° C., sufficient low temperature fixability can be obtained.

The crystalline resin is not particularly limited as long as it has crystallinity, and a conventionally known crystalline resin in this technical field can be used. Specific examples of the crystalline resin may include the crystalline polyester resin described above, the crystalline polyurethane resin, the crystalline polyurea resin, the crystalline polyamide resin, the crystalline polyether resin. The crystalline resin can be used alone or in a combination of two or more kinds thereof.

Among them, the crystalline resin is preferably a crystalline polyester resin. The crystalline polyester resin has good dispersibility to the amorphous polyester resin and can further improve low temperature fixability. In addition, it is easy to control the reduction of the charge amount at the time of continuous printing by including the crystalline polyester resin, and thus the image quality at the time of continuous printing can be further improved.

The number average molecular weight (Mn) of the crystalline resin is not particularly limited, but is preferably in the range of 1,500 to 25,000, and more preferably in the range of 3,000 to 20,000. Within this range, the low temperature fixability can be further improved. The number average molecular weight (Mn) can be measured by gel permeation chromatography (GPC), and specifically, by the method described in Examples.

In the present invention, the content of the crystalline resin included in the black toner and the color toner (the total amount thereof when two or more crystalline resins are included) is preferably 8 to 30% by mass, and more preferably 10 to 25% by mass relative to the total mass of the binder resin. When the content of the crystalline resin is 8% by mass or more, appropriate plasticization progresses by compatibility with the vinyl resin and the amorphous polyester resin, and thus it is easy to exhibit an effect of low temperature fixability. Meanwhile, when the content of the crystalline resin is 30% by mass or less, plasticization is moderately suppressed, and thus offset in a high temperature fixing region is suppressed.

<Releasing Agent>

The black toner and the color toner (toner base particles of each toner) according to the present invention each include a releasing agent (wax). The releasing agent oozes out to the image surface during thermal fixation, thereby increasing glossiness. Further, since the external additives are easily buried in the part of the releasing agent present on the surface of the toner base particles as compared to the part of the binder resin, it is possible to improve the chargeability at the time of continuous printing by suppressing the exposure of the releasing agent.

Examples of the releasing agent may include low molecular weight polyolefins such as polyethylene, polypropylene, polybutene, and the like; oxidized polyolefins such as oxidized polyethylene, polypropylene, and the like, silicones showing softening point by heating; fatty acid amides such as oleic acid amide, erucic acid amide, ricinoleic acid amide, stearic acid amide, ethylenediamine behenyl amide, trimellitic acid tristearyl amide, and the like; dialkyl ketone wax such as distearyl ketone, and the like; plant-based wax such as carnauba wax, rice wax, candelilla wax, tree wax, jojoba oil, and the like; animal-based wax such as bees wax, and the like; long chain hydrocarbon-based waxes such as paraffin wax and sasol wax, and the like; branched chain hydrocarbon-based waxes such as microcrystalline wax and Fischer-Tropsch wax, and the like; ester waxes such as montan wax, stearyl stearate, behenyl behenate, butyl stearate, propyl oleate, glyceride monostearate, glyceride distearate, pentaerythritol tetrabehenic acid ester, trimethylolpropane tribehenic acid ester, pentaerythritol diacetate dibehenate, glycerin tribehenate, diethylene glycol monostearate, dipropylene glycol distearate, distearic acid diglyceride, sorbitan monostearate, 1,18-octadecane diol distearate, tristearyl trimellitate, distearyl malate and cholesteryl stearate, and the like. These releasing agents may be used alone or in a combination of two or more kinds thereof.

Among them, from the viewpoint that dispersibility by the vinyl resin can be easily controlled, and reduction of the charge amount in the color toner can be easily suppressed at the time of the continuous printing, as the releasing agent, it is preferable to use a long-chain hydrocarbon-based wax and a branched chain hydrocarbon-based wax which have high hydrophobicity.

In addition, a melting point of the releasing agent is preferably from 50 to 100° C., and more preferably from 70 to 95° C., from the viewpoints of low temperature fixability, releasability and glossiness of the toner in the electrophotographic system.

In the present invention, a content of the releasing agent included in the black toner and the color toner is not particularly limited as long as it satisfies the above formula (2). That is, it is sufficient that the value of Wc−Wk is more than 2 and less than 10. By satisfying this relationship, it is possible to improve the balance of gloss by controlling the glossiness of the black portion and the color portion, and to reduce the difference between the color toner and the black toner with respect to the reduction of the charge amount at the time of continuous printing relative to the initial stage. Therefore, it is possible to favorably maintain the image quality at the time of continuous printing. Here, Wc is the content (content ratio) of the releasing agent relative to the total mass of the binder resin included in the color toner, and Wk (unit: % by mass) is the content (content ratio) of the releasing agent relative to the total mass of the binder resin included in the black toner. Further, when two or more color toners are used, Wc is the content (content ratio) of the releasing agent relative to the total mass of the binder resin included in each color toner of each color. Therefore, Wc is a value defined for the color toner of each color. Further, in the case where two or more color toners are used, when at least one color toner satisfies the above formula (2), it is determined that the image forming method satisfies the above formula (2). However, from the viewpoint of appropriately controlling the glossiness of the color portion to improve the balance of gloss, and further favorably maintaining the image quality at the time of the continuous printing, it is preferable that all of the color toners used in the image forming method satisfy the above formula (2). Further, from the similar viewpoint, it is more preferable that all of the color toners satisfy the formula (4) described below, and particularly preferable that all of the color toners satisfy the formula (5).

In addition, from the viewpoint of improving the balance of the gloss of the black portion and the color portion and favorably maintaining the image quality during the continuous printing, the value of Wc−Wk is preferably more than 3, and more preferably more than 4. In addition, from the similar viewpoint, the value of Wc−Wk is preferably less than 8, and more preferably less than 7. Further, it is particularly preferable that the values of Wc and Wk satisfy the following formula (4). When the following formula (4) is satisfied, the balance between the gloss of the black portion and the color portion is improved, and the image quality during the continuous printing is improved. Further, from the similar viewpoint, it is most preferable that the values of Wc and Wk satisfy the following formula (5).

$$3<Wc-Wk<8 \quad (4)$$

$$4<Wc-Wk<7 \quad (5)$$

From the viewpoint of excellent dispersibility of the releasing agent and easiness of controlling the chargeability at the time of the continuous printing, the content (content ratio) of the releasing agent relative to the total mass of the binder resin in the color toner is preferably more than 5% by mass and less than 30% by mass, and more preferably 10 to 20% by mass. In addition, in the black toner, the content (content ratio) of the releasing agent relative to the total mass of the binder resin is preferably 3 to 20% by mass, and more preferably 5 to 15% by mass. Within this range, the low temperature fixability is also improved.

Further, the above-described Wk and Wc can be measured by on-line analysis using reactive pyrolysis or thermal desorption extraction GC/MS of the toner base particles, or by other device analysis, or the like. An example of pyrolysis GC/MS measurement conditions in the online analysis is shown below;

Equipment; Frontier Laboratories Ltd., PY-2020iD/Shimadzu GC-2010

Column; UA-1(MS/HT) 0.25 mm id×15 m, 0.10 μm

Detection; FID

Data processing quantitative calculation method: Absolute calibration curve method or standard addition method.

Further, in the case of other instrumental analysis, pretreatment for extracting the binder resin with an appropriate solvent (for example, n-hexane, cyclohexane, etc.) is performed, and then Wk and Wc can be measured using methods such as GC/MS, GC using a FID detector, $^{1}$HNMR, IR, and the like. Here, the extraction method in the pretreatment is not particularly limited, but known methods such as Soxhlet extraction, heating reflux, ultrasonic irradiation, and the like, can be appropriately employed.

<Binder Resin>

As described above, the binder resin included in the toner according to the present invention includes a polyester resin as a main component and a vinyl resin, and optionally includes a crystalline resin. Here, in the toner according to the present invention, the content of the vinyl resin (content ratio) and the content of the releasing agent (content ratio) relative to the total mass of the binder resin satisfy the above formula (1) and formula (2). Further, here, in order to more easily obtain the effect of the present invention, the content (content ratio) of the binder resin relative to the total mass of the toner base particles in the color toner is preferably 60 to 90% by mass and more preferably 70 to 85% by mass. In addition, in the black toner, the content (content ratio) of the binder resin relative to the total mass of the toner base particles is preferably 60 to 90% by mass, and more preferably 70 to 85% by mass. Further, it is particularly preferable that the content (content ratio) of the binder resin relative to the total mass of the toner base particles is the same in the black toner and the color toner. By adopting this form, amounts of the contents (content ratios) of the vinyl resin and the releasing agent in the color toner and the black toner are controlled relatively easily, and thus it is easier to obtain the effect according to the present invention.

<Colorant>

The black toner and the color toner (toner base particles of each toner) according to the present invention each include a colorant according to each color. Here, as one embodiment of the color toner, the color toner may include a yellow toner, a magenta toner, a cyan toner, and a color toner of other color. Further, as another embodiment of the color toner, the color toner may include a yellow toner, a magenta toner, and a cyan toner.

Commonly known carbon blacks, magnetic materials, dyes, pigments, and the like may be arbitrarily used as the colorant used for each toner. Hereinafter, types of colorants of each color are exemplified.

(Black Type Colorant)

As the black type colorant (pigment) used in the black toner according to the present invention, for example, known colorants, such as carbon blacks such as furnace black, channel black, acetylene black, thermal black, lamp black, and the like; magnetic powder such as magnetite, ferrite, and the like; dyes; and inorganic pigments including non-magnetic iron oxide, and the like, can be arbitrarily used.

(Yellow Type Colorant)

The colorant for orange or yellow used in the yellow toner is not particularly limited. For example, as the organic pigment, C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, and the like, may be included. In addition, as the dye, for example, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, and the like, may be included. These colorants may be used alone or in a combination of two or more kinds thereof.

(Magenta Type Colorant)

The colorant for magenta or red used for magenta toner is not particularly limited. For example, as an organic pigment, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48;1, C.I. Pigment Red 53;1, C.I. Pigment Red 57;1, Pigment Red 81;4, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, Pigment Red 184, C.I. Pigment Red 222, C.I. Pigment Red 238, C.I. Pigment Red 269, and the like, may be included. In addition, as the dye, for example, C.I. Solvent Red 1, Solvent Red 11, C.I. Solvent Red 49, C.I. Solvent Red 52, C.I. Solvent Red 58, C.I. Solvent Red 68, C.I. Solvent Red 111, C.I. Solvent Red 122, and the like, can be included. These colorants may be used alone or in a combination of two or more kinds thereof.

(Cyan Type Colorant)

The colorant for green or cyan used in the cyan toner is not particularly limited. For example, as an organic pigment, C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, C.I. Pigment Blue 76, C.I. Pigment Green 7, and the like, may be included. In addition, as the dye, for example, C.I. Solvent Blue 25, C.I. Solvent Blue 36, C.I. Solvent Blue 69, C.I. Solvent Blue 70, C.I. Solvent Blue 93, C.I. Solvent Blue 95, and the like, may be included. These colorants may be used alone or in a combination of two or more kinds thereof.

(Content of Colorant)

The content of each colorant is preferably 1 to 30 parts by mass, and more preferably 3 to 20 parts by mass relative to 100 parts by mass of the toner base particles. In addition, within this range, color reproducibility of the image can be ensured.

(Size of Colorant Particle)

In addition, a size of the colorant (particle) is not particularly limited, but a volume-based median diameter is preferably 10 to 1000 nm, more preferably 50 to 500 nm, and particularly preferably 80 to 300 nm. This range is preferable in that not only high color reproducibility can be obtained, but also it is suitable for formation of a small diameter toner which is necessary for high image quality. Further, the volume-based median diameter of the colorant (particle) can be measured using, for example, MICROTRACK (registered trademark, hereinafter the same) laser diffraction type particle size distribution measuring apparatus "LA-700" (manufactured by HORIBA Ltd.).

<Charge Control Agent>

The black toner and the color toner (toner base particles of each toner) according to the present invention may include other internal additives as necessary. As the internal additive, a charge control agent may be included. Examples of charge control agent may include, metal complexes (salicylic acid metal complexes) of salicylic acid derivative and zinc or aluminum, calixarene compounds, organic boron compounds, and fluorine-containing quaternary ammonium salt compounds.

A content of the charge control agent is preferably 0.1 to 10 parts by mass, and more preferably from 0.5 to 5 parts by mass relative to 100 parts by mass of the binder resin in the toner.

<External Additive>

The black toner and the color toner according to the present invention contain an external additive from the viewpoint of improving chargeability, flowability, or a cleaning property. Examples of the external additive can include known particles such as inorganic particles and organic particles, lubricants, and the like. The external additive is present in the form that the external additive is adhered to the surface of the toner base particles in the toner. Variety of external additives may be used in combination.

Examples of the particles used as the external additive may include inorganic oxide particles such as silica particles, alumina particles and titania particles; inorganic stearate compound particles such as aluminum stearate particles and zinc stearate particles; inorganic titanate compound particles such as strontium titanate particles, zinc titanate particles, and the like. In addition, examples of the lubricant may include metal salts of higher fatty acids, such as stearate salts of zinc, aluminum, copper, magnesium, calcium, or the like, palmitate salts of zinc, copper, magnesium, calcium, or the like, linoleate salts of zinc, calcium, or the like, and ricinoleate salts of zinc, calcium, or the like. From the viewpoint of a thermal resistant storage property and environmental stability, these external additives may be surface-treated with a silane coupling agent, a titanium coupling agent, higher fatty acid, silicone oil, or the like. These external additives may be used alone or in a mixture of two or more thereof.

Among them, inorganic oxide particles such as silica particles (spherical silica), alumina particles and titania particles are preferably used as the external additive.

An added amount of the external additive (the total amount when two or more kinds are used) is preferably 0.05 to 5 parts by mass, and more preferably from 0.1 to 3 parts by mass, relative to 100 parts by mass of the toner base particles.

The particle size of the external additive is not particularly limited, but inorganic fine particles having a number average primary particle diameter of about 2 to 800 nm or organic fine particles having a number average primary particle diameter of about 10 to 2,000 nm are preferable. In the present description, the "number average primary particle diameter" is a value obtained by binarizing a scanning electron microscopic image of external additive particles, calculating the horizontal Feret diameter for 10,000 particles, and calculating an average value thereof.

<Morphology (Structure) of Toner (Base) Particles>

With respect to the black toner and the color toner according to the present invention, the toner (base) particles may have so-called a single-layer structure and a core-shell structure (a form in which a resin for forming a shell layer is aggregated and fused on the surface of core particles). The core-shell structure is not limited to a structure in which the shell layer completely covers the core particles. For example, the core-shell structure also includes a structure in which the shell layer does not completely cover the core particles, and some core particles are exposed.

In addition, from the viewpoint of obtaining good image quality without lowering the charge amount of the color toner at the time of continuous printing, in the color toner according to the present invention, it is preferable that the releasing agent is not exposed on the surface of the toner base particles, but is contained (included) in the inside of the toner particles. Meanwhile, from the viewpoint of lowering the reduction of the charge amount of the color toner at the time of the continuous printing, in the black toner according to the present invention, it is preferable that the releasing agent is exposed on the surface of the toner base particles.

As described above, each form of the toner base particles of the color toner and black toner can be controlled by the content (content ratio) of the releasing agent and the vinyl resin. In addition, as described later, when the toner particles are produced by the emulsion aggregation method, the morphology of the toner base particles may be controlled by the timing of addition of the releasing agent or the binder resin.

The morphology of the toner base particles (the cross-sectional structure of the core-shell structure or the position where the releasing agent is present) can be confirmed using known means such as a transmission electron microscope (TEM), a scanning probe microscope (SPM), or the like.

<Particle Size of Toner Particle>

With respect to the black toner and the color toner according to the present invention, the particle size of the toner particles is not particularly limited, but it is preferable that the volume-based median diameter (D50) is 3 to 10 μm. By setting the volume-based median diameter within the above range, it is possible to achieve fine line reproducibility or high image quality of the photographic image and to reduce toner consumption as compared to a case of using a large particle diameter toner. In addition, toner flowability can also be ensured. Here, the volume-based median diameter (D50) of the toner particle can be measured and calculated, for example, using a device in which a computer system for data processing is connected to "COULTER MULTISIZER II" (manufactured by Beckman Coulter, Inc.). As an electrolyte, "ISOTON (registered trademark) II" (manufactured by Beckman Coulter, Inc.) may be used.

The volume-based median diameter of the toner particles can be controlled by concentration of an aggregating agent or an added amount of a solvent in the aggregation/fusion process, or fusion time, or the composition of the resin component, or the like, at the time of producing the toner to be described below.

<CV Value of Toner Particle>

With respect to the black toner and the color toner according to the present invention, a coefficient of variation (CV value, also referred to simply as "CV value" in the present description) in the volume-based particle size distribution of the toner particles is not particularly limited, but is preferably 15 to 25%. The CV value represents the degree of dispersion in particle size distribution of the toner particles on a volume basis and is represented by the following formula (A). The smaller the CV value, the sharper the particle size distribution, it is indicated that the size of the toner particles is uniform.

$$\text{Coefficient of variation (CV value) (\%)}=[(\text{Standard deviation in volume-based particle size distribution})/(\text{Median diameter on volume basis } (D_{50}))]\times 100 \quad \text{(A)}$$

The CV value of the toner particles can be controlled, for example, by adjusting the amount of an aggregation stopper used in the production of the toner. In addition, the volume-based median diameter and CV value of the toner particles can be measured by "COULTER MULTISIZER II" (manufactured by Beckman Coulter, Inc.).

<Average Circularity of Toner Particles>

Regarding the black toner and the color toner according to the present invention, an average circularity of the toner particles is not particularly limited, but from the viewpoint of improving the low temperature fixability, the average circularity is preferably 0.920 to 1.000, and more preferably 0.940 to 0.995. Here, the average circularity is a value measured using "FPIA-3000" (manufactured by Sysmex Corporation). Specifically, the toner particles are wetted in an aqueous surfactant solution, dispersed by ultrasonic dispersion for 1 minute, and then measured at an appropriate concentration with the number of HPF detection of 4000 in the measurement condition of HPF (high magnification imaging) mode using "FPIA-3000". The circularity is calculated by the following formula;

$$\text{Circularity}=(\text{circumferential length of a circle having an equivalent to a projected area of a particle image})/(\text{circumferential length of a projected image of a particle})$$

Further, the average circularity is an arithmetic mean value obtained by summing the circularities of respective particles and dividing the sum by the total number of particles measured.

<Softening Point of Toner>

A softening point (Tsp) of the black toner and the color toner according to the present invention is not particularly limited, but it is preferably 90 to 140° C., and more preferably 100 to 130° C. By setting the softening point temperature within the above range, good low temperature fixability can be obtained. Further, wider and more stable color reproducibility can be obtained in the formed visible image.

Here, as one embodiment of the combination of the black toner and the color toner according to the present invention, a form in which the softening point (Tspk) of the black toner is higher than the softening point (Tspc) of the color toner, that is, Tspk>Tspc may be included. As described above, since the toner according to the present invention satisfies Wc>Wk, it is thought that the black toner is more difficult to plasticize during thermal fixation. In other words, the softening point of the black toner is higher than that of the color toner. Therefore, according to this embodiment, since the black toner is difficult to plasticize, the glossiness of the black portion can be lowered, but the glossiness of the color portion can be increased in the image to be formed. As a result, the balance of glossiness can be improved.

In addition, when two or more color toners are used, it is preferable that at least one color toner satisfies the above softening point relationship (Tspk>Tspc). However, from the viewpoint of appropriately controlling the glossiness of the black portion and the color portion to improve the balance of gloss, it is preferable that all of the color toners used in the image forming method satisfy the above softening point relationship.

The softening point of the toner can be controlled, for example, by (1) adjusting the type and composition ratio of the monomer constituting the binder resin, (2) adjusting the molecular weight of the binder resin, (3) adjusting the type and used amount of the constituent materials such as a releasing agent, and the like, or by combining these methods (1) to (3).

In the present description, the softening point of the toner can be measured using "Flow Tester CFT-500" (manufactured by SHIMADZU CORPORATION). Specifically, the softening point (Tsp) is measured by the method described in Examples.

[Production Method of Toner]

A production method of the black toner and the color toner (toner for developing electrostatic latent image) according to the present invention is described.

The production method of the toner (toner base particles) according to the present invention is not particularly limited, but may include known methods such as a kneading-pulverization method, a suspension polymerization method, an emulsion aggregation method, a dissolution suspension method, a polyester elongation method, a dispersion polymerization method, and the like.

Among them, from the viewpoints of uniformity of the particle size, controllability of the shape, easiness of forming the core-shell structure, it is preferable to employ the emulsion aggregation method. Hereinafter, the emulsion aggregation method is described.

<Emulsion Aggregation Method>

The emulsion aggregation method is a method of producing toner base particles in which dispersion liquid of particles of a binder resin dispersed by using a surfactant or a dispersion stabilizer (hereinafter also referred to as "binder resin particles") is mixed with dispersion liquid of particles of a releasing agent (hereinafter also referred to as "releasing agent particles"), the particles are aggregated until to have a desired particle size, and further the binder resin particles are fused with one another to control the shape. Here, the particles of the binder resin may arbitrarily contain a colorant, a charge control agent, and the like. In addition, a colorant may be added, which is in the form of dispersion liquid of colorant particles, to the dispersion liquid of the binder resin particles and the dispersion liquid of the releasing agent particles.

In the case of producing a toner for developing an electrostatic latent image by the emulsion aggregation method, the production method according to the preferred embodiment includes;

(a) preparing vinyl resin particle dispersion liquid, polyester resin particle dispersion liquid and releasing agent particle dispersion liquid, and if necessary, colorant particle dispersion liquid and crystalline resin particle dispersion liquid (hereinafter also referred to as a preparation process); and (b) mixing the vinyl resin particle dispersion liquid, the polyester resin particle dispersion liquid and the releasing agent particle dispersion liquid, and if necessary, the colorant particle dispersion liquid and the crystalline resin particle dispersion liquid, followed by aggregation and fusion (hereinafter, also referred to as aggregation/fusion process).

Hereinafter, processes (a) to (b) and processes (c) to (g) to be arbitrarily carried out will be described in detail.

(a) Preparation Process

The process (a) includes a polyester resin particle dispersion liquid preparation process, a vinyl resin particle dispersion liquid preparation process, a releasing agent particle dispersion liquid preparation process, and, if necessary, a colorant particle dispersion liquid preparation process.

(a-1) Polyester Resin Particle Dispersion Liquid Preparation Process

The polyester resin particle dispersion liquid preparation process is a process of synthesizing a polyester resin constituting a binder resin and dispersing the polyester resin in a fine particle form in an aqueous medium to prepare dispersion liquid of polyester resin particles.

Since the production method of the polyester resin (amorphous polyester resin and crystalline polyester resin) is as described above, description thereof is omitted.

The polyester resin particle dispersion liquid may be prepared, for example, by a method of performing dispersion treatment in an aqueous medium without using a solvent (organic solvent), or a method of dissolving the polyester resin in a solvent (organic solvent) such as ethyl acetate, methyl ethyl ketone, or the like, to prepare a solution, emulsifying and dispersing the solution in an aqueous medium with a dispersing machine, and performing a desolvation treatment, and the like.

In the present invention, the term "aqueous medium" refers to a medium containing at least 50% by mass or more of water. Examples of a component other than water may include an organic solvent which is soluble in water, and examples thereof may include methanol, ethanol, isopropanol, acetone, dimethylformamide, methyl cellosolve, tetrahydrofuran, and the like. Among them, it is preferable to use an alcohol-based organic solvents such as methanol, ethanol or isopropanol of an organic solvent which does not dissolve the resin. Preferably, only water is used as the aqueous medium.

In the case where the polyester resin includes a carboxyl group in its structure, ammonia, sodium hydroxide or the like may be added so that the carboxyl group is ionically dissociated and stably emulsified in an aqueous phase, and emulsification proceeds smoothly. Further, a dispersion stabilizer may be dissolved in the aqueous medium, and a surfactant, a resin particle or the like may be added for the purpose of improving the dispersion stability of oil droplets.

As the dispersion stabilizer, known dispersion stabilizers may be used. For example, dispersion stabilizers that are soluble in acid or alkali such as tricalcium phosphate, or the like, are preferably used. From the viewpoint of environment, dispersion stabilizers that can be decomposed by enzymes are preferably used. As the surfactant, known anionic surfactants, cationic surfactants, nonionic surfactants and amphoteric surfactants may be used. In addition, examples of the resin particles for improving dispersion stability may include polymethyl methacrylate resin particles, polystyrene resin particles, polystyrene-acrylonitrile resin particles, and the like.

This dispersion treatment may be performed by using mechanical energy, and the dispersing machine is not particularly limited, and may include a homogenizer, a low-speed shearing type dispersing machine, a high-speed shearing type dispersing machine, a friction type dispersing machine, a high pressure jet type dispersing machine, an ultrasonic dispersing machine, a high pressure impact type dispersing machine, ULTIMIZER, an emulsifying dispersing machine, and the like.

In dispersing, it is preferable to heat the solution. A heating condition is not particularly limited, but it is usually about 60 to 200° C.

In addition, in the method of emulsifying and dispersing the solution obtained by dissolving a polyester resin in a solvent (organic solvent) in an aqueous medium and performing a desolvation treatment, the desolvation treatment is performed by a known method, preferably a method of heating the solution at 30 to 80° C. under reduced pressure to distill off the solvent.

A volume-based median diameter of the polyester resin particles in the polyester resin particle dispersion liquid thus prepared is preferably 60 to 1000 nm, and more preferably 80 to 500 nm. In addition, the median diameter can be controlled by the magnitude of the mechanical energy at the time of emulsifying and dispersing, and the like.

Further, the content of the polyester resin particles in the polyester resin particle dispersion liquid is preferably in the range of 10 to 50% by mass, and more preferably in the range of 15 to 40% by mass relative to the total amount of the dispersion liquid. Within this range, spreading of the particle size distribution can be suppressed and the toner characteristics can be improved.

(a-2) Vinyl Resin Particle Dispersion Liquid Preparation Process

The vinyl resin particle dispersion liquid preparation process is a process of preparing an aqueous dispersion liquid of the vinyl resin constituting the binder resin.

As an example of the preparation process of the vinyl resin particle dispersion liquid, the following method is provided. That is, there is a method in which emulsion polymerization is performed in an aqueous medium to obtain a vinyl resin, and thus a liquid after the polymerization reaction is used as it is as a vinyl resin particle dispersion liquid.

Alternatively, a method of pulverizing the isolated vinyl resin, if necessary, and dispersing the vinyl resin in an aqueous medium using an ultrasonic disperser, or the like, in the presence of a surfactant, can also be used. Examples of the aqueous medium and the surfactant are similar to those of (a-1) above, and thus description thereof is omitted.

The volume-based median diameter of the vinyl resin particles in the vinyl resin particle dispersion liquid is preferably 60 to 1000 nm, and preferably 80 to 500 nm. In addition, the median diameter can be controlled by the magnitude of the mechanical energy at the time of polymerization, and the like.

The content of the vinyl resin particles in the vinyl resin particle dispersion liquid is preferably in the range of 10 to 50% by mass, and more preferably in the range of 15 to 40% by mass relative to the total amount of the dispersion liquid. Within this range, spreading of the particle size distribution can be suppressed and the toner characteristics can be improved.

(a-3) Releasing Agent Particle Dispersion Liquid Preparation Process

The releasing agent particle dispersion liquid preparation process is a process of preparing a dispersion liquid of releasing agent particles by dispersing the releasing agent in the form of fine particle in an aqueous medium.

The aqueous medium is as described in the above (a-1), and a surfactant, a resin particle, or the like may be added to the aqueous medium for the purpose of improving dispersion stability.

Dispersion of the releasing agent may be performed by using mechanical energy. There is no particular limitation on the dispersing machine, and the dispersing machine described in (a-1) above may be used.

The volume-based median diameter of the releasing agent particles in the releasing agent particle dispersion liquid is preferably in the range of 10 to 300 nm.

The content of the releasing agent particles in the releasing agent particle dispersion liquid is preferably in the range of 5 to 45% by mass, and more preferably in the range of 8 to 30% by mass relative to the total amount of the dispersion liquid. Within this range, effects of preventing hot offset and securing separability are obtained.

(a-4) Colorant Particle Dispersion Liquid Preparation Process

The colorant particle dispersion liquid preparation process is a process of preparing a dispersion liquid of colorant particles by dispersing the colorant in the form of fine particle in an aqueous medium, and it is an optional process.

Since the aqueous medium is as described in (a-1) above, description thereof is omitted. A surfactant, resin particles, or the like may be added to the aqueous medium for the purpose of improving the dispersion stability.

Dispersion of the colorant can be performed by a dispersing machine using mechanical energy, there is no particular limitation on the dispersing machine, and the dispersing machine described in (a-1) above can be used.

The volume-based median diameter of the colorant particles in the colorant particle dispersion liquid is preferably in the range of 10 to 300 nm.

The content of the colorant in the colorant particle dispersion liquid is preferably in the range of 5 to 45% by mass, and more preferably in the range of 10 to 30% by mass relative to the total amount of the dispersion liquid. Within this range, there is an effect of securing color reproducibility.

(b) Aggregation/Fusion Process

This aggregation/fusion process is a process of aggregating the above-described polyester resin particles, vinyl resin particles and releasing agent particles, and, if necessary, colorant particles in an aqueous medium and simultaneously fusing these particles.

In this process, first, the polyester resin particle dispersion liquid, the vinyl resin particle dispersion liquid, and the releasing agent particle dispersion liquid, and, if necessary, the colorant particle dispersion liquid are mixed and these particles are dispersed in the aqueous medium.

Next, after adding an aggregating agent, aggregation proceeds by heating at a glass transition temperature or higher of the polyester resin and the vinyl resin, and simultaneously, the resin particles are fused together.

The aggregating agent is not particularly limited, but is preferably selected from metal salts such as alkali metal salts and salts of Group 2 metals. Examples of the metal salt may include monovalent metal salts such as sodium, potassium and lithium; divalent metal salts such as calcium, magnesium, manganese, and copper; and trivalent metal salts such as iron and aluminum, and the like. Specific metal salts may include sodium chloride, potassium chloride, lithium chloride, calcium chloride, magnesium chloride, zinc chloride, copper sulfate, magnesium sulfate, manganese sulfate, aluminum sulfate, and the like. Among them, it is particularly preferable to use a divalent or trivalent metal salt since aggregation can proceed in a smaller amount. These aggregating agents may be used alone or in a combination of two or more kinds thereof.

The amount of the aggregating agent to be used is not particularly limited, but is preferably 0.1 to 20 parts by mass, and more preferably 1 to 15 parts by mass, relative to 100 parts by mass of the solid content of the binder resin.

In the aggregation process, after adding the aggregating agent, it is preferable to quickly raise a temperature by heating, and a temperature rising rate is preferably 0.05° C./min or more. The upper limit of the heating rate is not particularly limited, but is preferably 15° C./min or less from the viewpoint of suppressing generation of coarse particles due to rapid progress of fusion. Further, after the dispersion liquid for aggregation reaches a desired temperature, it is preferable to maintain the temperature of the dispersion liquid for aggregation for a certain period of time, preferably until the volume-based median diameter reaches 4.5 to 7.0 μm, and to continue the fusion.

(c) Aging Process

This process is arbitrarily carried out. In the aging process, agglomerated particles obtained by the aggregation/fusion process are aged by thermal energy until a desired shape is obtained, and thus aging treatment of forming toner particles is performed.

Specifically, the aging treatment is performed by heating and stirring a system in which agglomerated particles are dispersed and adjusting a heating temperature, a stirring speed, heating time, and the like, until a shape of the agglomerated particle reaches to have a desired circularity.

(d) Cooling Process

This process is a process of cooling the dispersion liquid of the toner particles. As a condition of the cooling treatment, it is preferable to cool the dispersion liquid of toner particles at a cooling rate of 1 to 20° C./min. A specific method of the cooling treatment is not particularly limited, and examples of the cooling treatment may include a cooling method by introducing a refrigerant from the outside of a reaction vessel, a cooling method by directly introducing cold water into a reaction system, and the like.

(e) Filtration/Washing Process

This process is a process of separating the toner particles from the cooled dispersion liquid of the toner particles thorough solid-liquid separation, and removing and washing a deposit such as a surfactant, an aggregating agent, or the like, from a toner cake obtained through solid-liquid separation (an aggregate obtained by agglomerating toner particles in a wet state in a cake form).

Specific solid-liquid separation and washing methods may include a centrifugal separation method, a reduced pressure filtration method using an aspirator, a Nutsche, or the like, a filtration method using a filter press, or the like, and these methods are not particularly limited. In this filtration/washing process, pH adjustment, pulverization, or the like may be performed as appropriate. Further, these operations may be repeated.

(f) Drying Process

This process is a process of drying the washed toner cake, and may be performed in accordance with a drying process in a generally known production method of toner particles.

Specifically, as a dryer used for drying the toner cake, a spray dryer, a vacuum freeze dryer, a reduced pressure dryer, and the like, may be included. It is preferable to use a stationary shelf dryer, a movable shelf dryer, a fluidized bed dryer, a rotary dryer, a stirring dryer, or the like.

(g) External Additive Addition Process

This process is a process performed as necessary in the case of adding an external additive to the toner particles.

As a mixing device of the external additive, a mechanical mixing device such as a HENSCHEL MIXER (registered trademark), a coffee mill, a sample mill or the like can be used.

<Developer>

Each of the black toner and the color toner may be used as a magnetic or non-magnetic one-component developer, but the black toner and the color toner may be mixed with a carrier and used as a two-component developer. In the case where the toner is used as a two-component developer, as the carrier, magnetic particles made of a conventionally known material such as a metal such as iron, ferrite, magnetite, and an alloy of the metal thereof with a metal such as aluminum, lead may be used, and particularly ferrite particles are preferable. Further, as the carrier, a coated carrier obtained by coating the surface of magnetic particles with a coating agent such as a resin, or the like, or a dispersion type carrier obtained by dispersing a magnetic material fine powder in a binder resin or the like may be used.

The volume average particle diameter of the carrier is preferably 20 to 100 μm, and more preferably 25 to 80 μm. The volume average particle diameter of the carrier can be typically measured by a laser diffraction type particle size distribution measuring apparatus "HELOS" (manufactured by Sympatec Inc.) equipped with a wet type dispersing machine.

The two-component developer may be prepared by mixing the carrier and the toner using a mixing device. Examples of mixing device may include HENSCHEL MIXER (registered trademark), NAUTA MIXER (registered trademark), V type mixer, and the like.

A blending amount of the toner when preparing the two-component developer is preferably 1 to 10% by mass relative to 100% by mass of the sum of the carrier and the toner.

<Image Forming Method>

The image forming method of the present invention includes forming an image forming layer (toner image) on a recording medium (image support) using the toner (toner for developing electrostatic latent image). Therefore, as another embodiment of the present invention, there is also provided a toner set for developing an electrostatic latent image including a black toner and a color toner other than the black toner. In the toner set for developing an electrostatic latent image, the black toner and the color toner each include a binder resin including a polyester resin as a main component and a vinyl resin, a releasing agent, and an external additive, and the following formula (1) and formula (2) are satisfied wherein Vk (unit: % by mass) is a content of the vinyl resin relative to the total mass of the binder resin included in the black toner, Vc (unit: % by mass) is a content of the vinyl resin relative to the total mass of the binder resin included in the color toner, Wk (unit: % by mass) is a content of the releasing agent relative to the total mass of the binder resin included in the black toner, and Wc (unit: % by mass) is a content of the releasing agent relative to the total mass of the binder resin included in the color toner.

$$2<Vk-Vc<50 \quad (1)$$

$$2<Wc-Wk<10 \quad (2)$$

The image forming method according to the present invention is a method using the black toner and the color toner (for example, a yellow toner, a magenta toner, a cyan toner, etc.) other than the black toner and can be preferably used for a full-color image forming method. In the full-color image forming method, any image forming method may be used, for example, a method of using a 4-cycle type image forming method including 4 kinds of color developing devices for each of yellow, magenta, cyan and black, and one electrostatic latent image carrier (also referred to as 'electrophotographic photoreceptor' or simply 'photoreceptor'), or a method of using a tandem type image forming device in which image forming units having color developing devices for respective colors and electrostatic latent image carriers are mounted for each color, or the like. The image forming method according to the present invention is particularly preferably used in an image forming method including sequentially transferring a toner image formed with a black toner and a toner image formed with a color toner to an intermediate transfer body (intermediate transfer belt).

As the image forming method, an image forming method including a fixing process using a heat pressure fixing system (thermocompression fixing system) capable of applying pressure and heating may be preferably included.

Specifically, for example, an electrostatic latent image formed on a photoreceptor is developed to obtain a toner image by using the toner, this toner image is transferred to an image support, and then the toner image transferred onto the image support is fixed on the image support by a fixing process using the heat pressure fixing system, whereby a printed matter on which a visible image is formed can be obtained.

It is preferable to simultaneously perform pressure application and heating in the fixing process. Alternatively, first, pressure may be applied and then heating may be performed.

As described above, in the image forming method according to the present invention, the content of the vinyl resin and the content of the releasing agent in the black toner and the color toner to be used satisfy the above formula (1) and formula (2). By using such toners, it is possible to improve balance between the gloss of the black portion and the color portion and to reduce a difference between the color toner and the black toner with respect to the reduction of the charge amount at the time of the continuous printing as compared to the initial stage. Therefore, the image quality can be favorably maintained without deteriorating the image quality even at the time of continuous printing.

Further, the image forming method according to the present invention is preferably used in an image forming method using a heat pressure fixing system. As a fixing device using the heat pressure fixing system used in the image forming method according to the present invention, various fixing devices known in the art can be used. Hereinafter, as the heat pressure fixing device, a fixing device and a heat roller system and a fixing device having a belt heating system will be described.

(i) Fixing Device Having Heat Roller System

The fixing device having a heat roller system generally has a pair of rollers composed of a heating roller and a pressure roller abutting on the heating roller. In the fixing device, the pressure roller is deformed by a pressure applied between the heating roller and the pressure roller, so that a so-called fixing nip portion is formed in this deformed portion.

Generally, in the heating roller, a heat source such as a halogen lamp is arranged in the inside of a core metal made of a hollow metal roller made of aluminum, or the like. In the heating roller, the core metal is heated by the heat source. In this case, a temperature is adjusted by controlling electrical conduction to the heat source so that a temperature of an outer peripheral surface of the heating roller is maintained at a predetermined fixation temperature.

In the case in which the fixing device is used in an image forming apparatus forming a full color image which is required to have an ability to sufficiently heat and melt toner images composed of four toner layers (yellow, magenta, cyan, and black) to mix colors, it is preferable that the fixing device has the following configuration. That is, the fixing device preferably includes a heating roller in which the core metal having a high heat capacity and an elastic layer for homogeneously melting the toner image is formed on the outer peripheral surface of the metal core.

Further, the pressure roller has an elastic layer made of, for example, a soft rubber such as urethane rubber, silicone rubber, or the like.

As the pressure roller, a pressure roller having a core metal constituted by a hollow metal roller made of aluminum, or the like, and an elastic layer formed on an outer peripheral surface of the core metal may be included.

Further, when the pressure roller has a core metal, a heat source such as a halogen lamp may also be arranged in the inside of the core metal similarly to the heating roller. In addition, it may be configured as one in which the core metal is heated by the heat source, and a temperature is adjusted by controlling electrical conduction to the heat source so that a temperature of the outer peripheral surface of the pressure roller is maintained at a predetermined fixation temperature.

As the heating roller and/or the pressure roller, it is preferable to use a roller in which a release layer made of a fluoride resin such as polytetrafluoroethylene (PTFE), a tetrafluoroethylene-perfluoroalkyl vinyl ether copolymer (PFA), or the like, is formed as an outermost layer.

In this fixing device having a heat roller system, the heating by the heating roller and application of pressure at the fixing nip portion are conducted by rotating the pair of rollers and sandwiching and conveying an image support on which a visible image will be formed at the fixing nip portion, whereby an unfixed toner image is fixed on the image support.

The image forming method of the present invention has a feature that the low temperature fixability is also improved. Therefore, in the fixing device having a heat roller system, a temperature of the heating roller can be set to be comparatively low, specifically 150° C. or less. In view of excellent low temperature fixability, it is more preferable as the temperature of the heating roller is lower, and a lower limit value thereof is not particularly limited, but is substantially about 90° C.

(ii) Fixing Device Having Belt Heating System

A fixing device having belt heating system generally includes a heating body made of, for example, a ceramic heater, a pressure roller, and a fixing belt made of a heat resistant belt interposed between the heating body and the pressure roller, wherein the pressure roller is deformed by a pressure applied between the heating body and the pressure roller so that a so-called fixing nip portion is formed in this deformed portion.

As the fixing belt, heat resistant belt and sheet, and the like, which are made of polyimide, or the like, can be used. Further, the fixing belt may have a structure in which the heat resistant belt or sheet made of polyimide or the like, serves as a substrate, and a release layer made of a fluoride resin such as polytetrafluoroethylene (PTFE) or a tetrafluoroethylene-perfluoroalkylvinylether copolymer (PFA) is formed on the substrate. Further, the fixing belt may have a structure in which an elastic layer made of rubber, or the like, is arranged between the substrate and the release layer.

In the fixing device having belt heating system as described above, an image support supporting an unfixed toner image is sandwiched and conveyed together with the fixing belt to between the pressure roller and the fixing belt forming the fixing nip portion. Therefore, the heating by the heating body via the fixing belt and application of pressure at the fixing nip portion are performed, and the unfixed toner image is fixed on the image support.

According to the fixing device having belt heating system as described above, the heating body may be in a state of being heated at a predetermined fixing temperature by energizing the heating body only at the time of image formation. Therefore, it is possible to shorten a waiting time from when the image forming apparatus is powered on to when the image formation can be executed. In addition, power consumption of the image forming apparatus at the time of standby is extremely small, such that power saving can be achieved.

As described above, the heating body, the pressure roller, and the fixing belt used as fixing members in the fixing process preferably have a configuration consisting of a plurality of layers.

In the fixing device having belt heating system, a temperature of the heating body can be set to be comparatively low, specifically 150° C. or less. Further, the temperature of the heating body is preferably 140° C. or less, and more preferably 135° C. or less. In view of excellent low temperature fixability, it is more preferable as the temperature of the heating body is lower, and a lower limit value thereof is not particularly limited, but is substantially about 90° C.

(Recording Medium (Image Support))

A recording medium (also referred to as a recording material, recording paper, a recording sheet, etc.) may be one generally used and is not particularly limited as long as it can maintain a toner image formed by an image forming method known in the art, for example, using an image forming apparatus. Examples of usable image support may include plain paper including thin paper and thick paper, high quality paper, art paper, coated printing paper such as coated paper, commercially available Japanese paper or post card paper, plastic film for OHP, fabrics, various resin materials used for so-called soft packaging, or resin films made of various resin materials in a film form, and labels.

EXAMPLES

The effects of the present invention will be explained using the following Examples and Comparative Examples. In the following Examples, unless otherwise specified, the term "part" and "%" mean "part by mass" and "% by mass", respectively, and each operation was performed at room temperature (25° C.). It should be noted that the present invention is not limited to the following Examples.

<Each Analysis Condition>

[Glass Transition Temperature and Melting Point]

The glass transition temperature (Tg) of the vinyl resin and the amorphous polyester resin was measured using "Diamond DSC" (manufactured by PerkinElmer Inc.). First, 3.0 mg of a measurement sample (resin) was sealed in an aluminum pan and set in a sample holder of "Diamond DSC". An empty aluminum pan was used as a reference. A DSC curve was obtained under measurement conditions (temperature rising/cooling conditions) in which a first temperature rising process of increasing a temperature from 0° C. to 200° C. at a temperature rising rate of 10° C./min, a cooling process of cooling the temperature from 200° C. to 0° C. at a cooling rate of 10° C./min, and a second temperature rising process of increasing the temperature from 0° C. to 200° C. at a temperature rising rate of 10° C./min are sequentially performed. Based on the DSC curve obtained by this measurement, an extension line of the baseline before it starts rising to generate the first endothermic peak in the second temperature rising process and a tangent line indicating the maximum inclination thereof between a rising point and a peak apex of the first peak were drawn and then a temperature at a cross point thereof was regarded as the glass transition temperature (Tg).

Further, the melting point (Tm) of the crystalline polyester resin was set as a temperature of the peak top of the endothermic peak (endothermic peak having a half-value width within 15° C.) derived from the crystalline resin in the second temperature raising process based on the DSC curve obtained in the same manner as above.

[Softening Point of Toner]

The softening point (Tsp) of the toner was measured using a flow tester as described below. Specifically, first, under an environment of 20° C. and 50% RH, 1.1 g of a sample (toner) was placed in a petri dish, flattened, left for 12 hours or more, and then pressed in a molding machine "SSP-10A" (manufactured by SHIMADZU CORPORATION) at a force of 3820 kg/cm$^2$ for 30 seconds, thereby preparing a cylindrical molded sample having a diameter of 1 cm. Subsequently, the molded sample was extruded on and after the completion of preheating under a load of 196 N (20 kgf), a starting temperature of 60° C., a preheating time of 300 seconds, and a temperature raising rate of 6° C./min by a flow tester "CFT-500 D" (manufactured by SHIMADZU CORPORATION) using a piston with a diameter of 1 cm from a hole of a cylindrical die (1 mm in diameter×1 mm in height) under an environment of 24° C. and 50% RH, and an offset method temperature $T_{offset}$ measured at an offset value of 5 mm by the melting temperature measurement method of the temperature rising method was regarded as the softening point (Tsp) of the toner.

[Weight Average Molecular Weight and Number Average Molecular Weight of Resin]

The molecular weight (weight average molecular weight and number average molecular weight) of each resin by GPC was measured in the following manner. Specifically, tetrahydrofuran (THF) as a carrier solvent was flowed at a flow rate of 0.2 mL/min while maintaining a column temperature at 40° C. using an apparatus "HLC-8120 GPC" (manufactured by Tosoh Corporation) and a column "TSK guard column+TS Kgel Super HZ-M3 series (manufactured by Tosoh Corporation)". The measurement sample (resin) was dissolved in tetrahydrofuran to a concentration of 1 mg/mL. The solution was prepared by treatment at room temperature for 5 minutes using an ultrasonic dispersing machine. Subsequently, the solution was treated with a membrane filter having a pore size of 0.2 μm to obtain a sample solution, and 10 μL of this sample solution was injected into the apparatus together with the above-described carrier solvent, and detected using a refractive index detector (RI detector). The molecular weight distribution of the measurement sample was calculated based on a calibration curve prepared using monodispersed polystyrene standard particles. Ten points were used for the polystyrene for measuring the calibration curve.

Preparation of Each Dispersion Liquid

Production Example 1: Preparation of Crystalline Polyester Resin Particle Dispersion Liquid (DC1)

<Synthesis of Crystalline Polyester Resin (C1)>

250 parts by mass of dodecanedioic acid and 150 parts by mass of 1,9-nonanediol were placed in a reaction vessel equipped with a nitrogen inlet tube, a condenser, a stirrer and a thermometer, and the inside of the reaction vessel was replaced with dry nitrogen gas. Thereafter, 0.5 part by mass of dibutyltin oxide was added as an esterification catalyst. After reacting under stirring at 170° C. for 3 hours under nitrogen gas flow, the temperature was further raised to 210° C. over 1 hour. The inside of the reaction vessel was depressurized to 3 kPa, and the reaction was performed with stirred under reduced pressure for 13 hours, to obtain a crystalline polyester resin (C1).

The crystalline polyester resin (C1) thus obtained had a number average molecular weight (Mn) of 8,100 and a melting point (Tm) of 69° C.

<Preparation of Crystalline Polyester Resin Particle Dispersion Liquid (DC1)>

In a 3 L jacketed reaction tank (BJ-30N, manufactured by TOKYO RIKAKIKAI CO., LTD.) equipped with a condenser, a thermometer, a water-dripping device, and an anchor blade, 300 parts by mass of the crystalline polyester resin (C1), 160 parts by mass of methyl ethyl ketone (solvent), and 100 parts by mass of isopropyl alcohol (solvent) were charged, and then stirred and mixed at 100 rpm while maintaining at 70° C. with a water circulation type thermostatic bath, to dissolve the resin therein.

Next, a stirring rotation speed was set to 150 rpm, the water circulation type thermostatic bath was set to be at 66° C., and 17 parts by mass of 10% by mass ammonia water (reagent) was added over 10 minutes. Thereafter, a total of 900 parts by mass of ion-exchanged water kept at 66° C. was added dropwise at a rate of 7 parts by mass/minute, followed by phase inversion to obtain an emulsion.

In a 2 L eggplant type flask, 800 parts by mass of the emulsion obtained above and 700 parts by mass of ion-exchanged water were placed, and set in an evaporator (manufactured by TOKYO RIKAKIKAI CO., LTD.) equipped with a vacuum control unit via a trap ball.

The eggplant type flask was rotated and warmed with a hot water bath at 60° C., and the pressure was reduced to 7 kPa to remove the solvent while paying attention to bumping. When the solvent recovery amount reached 1100 parts by mass, the pressure returned to atmospheric pressure, and the eggplant type flask was cooled with water to obtain dispersion liquid. There was no solvent odor in the obtained dispersion liquid.

The volume-based median diameter D50 of the resin particles in this dispersion liquid was 130 nm. Then, ion exchanged water was added to adjust the solid content concentration to 20% by mass, and used as a crystalline polyester resin particle dispersion liquid (DC1). In this example, the volume-based median diameter (D50) was measured with a laser diffraction type particle size distribution measuring apparatus "LA-700" (manufactured by HORIBA Ltd.) (hereinafter, the same is applied).

Production Example 2: Preparation of Vinyl Resin Particle Dispersion Liquid (DV1)

A solution obtained by dissolving 16 parts by mass of sodium dodecylsulfate in 2800 parts by mass of ion-exchanged water was placed in a 5 L reaction vessel equipped with a stirring device, a temperature sensor, a cooling tube, and a nitrogen introducing device, and the internal temperature was raised to 80° C. while stirring at a stirring speed of 230 rpm under a nitrogen stream.

Next, a solution obtained by dissolving 20 parts by mass of potassium persulfate in 400 parts by mass of ion-exchanged water was added, and the liquid temperature was again brought to 80° C. Thereafter, a vinyl monomer solution consisting of the following raw materials was added dropwise over 1 hour, followed by heating and stirring for 2 hours to conduct polymerization. Thereafter, the solution was cooled to 28° C., whereby aqueous dispersion liquid (DV1) of vinyl resin particles made of a styrene acrylic resin was prepared. The volume-based median diameter D50 of the resin particles in this dispersion liquid was 108 nm. The styrene acrylic resin (VI) had a weight average molecular weight (Mw) of 22,000 and a glass transition temperature (Tg) of 45° C.

Styrene: 400 parts by mass
n-butyl acrylate: 236 parts by mass
Methacrylic acid: 56 parts by mass
Methyl methacrylate: 90 parts by mass
n-octyl-3-mercaptopropionate: 16 parts by mass.

Production Example 3: Preparation of Amorphous Polyester Resin Particle Dispersion Liquid (DA1)

<Synthesis of Amorphous Polyester Resin (A1)>

To a reaction vessel equipped with a nitrogen inlet tube, a condenser, a stirrer and a thermometer, 83 parts by mass of terephthalic acid, 66.5 parts by mass of dodecenylsuccinic acid anhydride, and 0.05 parts by mass of dibutyltin oxide as an esterification catalyst were added.

After reacting at 235° C. for 6 hours under a nitrogen gas stream, the temperature was lowered to 200° C., and 25 parts by mole of fumaric acid, 65 parts by mass of bisphenol A ethylene oxide 2.2-mol adduct, and 285 parts by mass of bisphenol A propylene oxide 2.2-mol adduct were added, and reacted for 1 hour. The temperature was further raised to 220° C. over 4 hours and polymerization was performed under a pressure of 10 kPa until reaching a desired molecular weight to obtain a transparent pale yellow amorphous polyester resin (A1).

The amorphous polyester resin (A1) thus obtained had a weight average molecular weight (Mw) of 13,000 and a glass transition temperature (Tg) of 61° C.

<Preparation of Amorphous Polyester Resin Particle Dispersion Liquid (DA1)>

In a 3 L jacketed reaction vessel (BJ-30N, manufactured by TOKYO RIKAKIKAI CO., LTD.) provided with a condenser, a thermometer, a water-dripping device, and an anchor blade, a mixed solvent of 160 parts by mass of ethyl acetate and 100 parts by mass of isopropyl alcohol was added and kept at 40° C. in a water circulation type thermostatic bath.

To this bath, 300 parts by mass of the amorphous polyester resin (A1) was added and stirred at 150 rpm using a three-one motor to be dissolved, thereby obtaining an oil phase.

To this stirred oil phase, 14 parts by mass of a 10% by mass aqueous ammonia solution was added dropwise for 5 minutes of dropping time and mixed for 10 minutes. Thereafter, 900 parts by mass of ion-exchanged water was added dropwise at a rate of 7 parts by mass per minute, followed by phase inversion to obtain an emulsion.

In a 2 L eggplant type flask, 800 parts by mass of the emulsion obtained above and 700 parts by mass of ion-exchanged water were placed, and set in an evaporator (manufactured by TOKYO RIKAKIKAI CO., LTD.) equipped with a vacuum control unit via a trap ball.

The eggplant type flask was rotated and warmed with a hot water bath at 60° C., and the pressure was reduced to 7 kPa to remove the solvent while paying attention to bumping. When the solvent recovery amount reached 1100 parts by mass, the pressure returned to atmospheric pressure, and the eggplant type flask was cooled with water to obtain dispersion liquid. There was no solvent odor in the obtained dispersion liquid.

The volume-based median diameter D50 of the resin particles in this dispersion liquid was 130 nm. Then, the ion-exchanged water was added to adjust the solid content concentration to 20% by mass, and used as an amorphous polyester resin particle dispersion liquid (DA1).

Production Example 4: Preparation of Releasing Agent Particle Dispersion Liquid (DW1)

hydrocarbon wax (Fischer Tropsch wax, manufactured by Nippon Seiro Co., Ltd., trade name: FNP0090, melting temperature=90.2° C.): 270 parts by mass anionic surfactant (Neogen (registered trademark) RK, active ingredient amount: 60% by mass, manufactured by Daiichi Kogyo Seiyaku Co., Ltd.): 13.5 parts by mass (as an active ingredient, 3.0% by mass relative to the releasing agent)

Ion-exchanged water: 21.6 parts by mass

The above components were mixed, and the releasing agent was dissolved with a pressure discharge type homogenizer (Gaulin homogenizer, manufactured by Gaulin Co., Ltd.) at an internal liquid temperature of 120° C. Thereafter, dispersion treatment was performed at a dispersion pressure of 5 MPa for 120 minutes and subsequently at 40 MPa for 360 minutes, followed by cooling to obtain a releasing agent dispersion liquid (DW1). The volume-based median diameter D50 of the releasing agent particles in this dispersion liquid was 225 nm. Then, the ion-exchanged water was added to adjust the solid content concentration to 20% by mass, and used as the releasing agent particle dispersion liquid (DW1).

Production Example 5: Preparation of Cyan Colorant Particle Dispersion Liquid (Cy)

Cyan pigment (C.I. Pigment Blue 15:3): 200 parts by mass

Anionic surfactant (Neogen (registered trademark) SC, manufactured by Daiichi Kogyo Seiyaku Co., Ltd.): 33 parts by mass (an active ingredient of 60% by mass, 10% by mass relative to the colorant)

Ion-exchanged water: 750 parts by mass

In a stainless steel container (having a size at which the height of the liquid surface was about 3 of the height of the container when all of the above ingredients were charged), 280 parts by mass of the ion-exchanged water and the anionic surfactant were added. The surfactant was sufficiently dissolved by warming to 40° C., followed by cooling to 25° C. The total amount of pigment was added thereto, and stirred using a stirrer until the unwetted pigment disappeared and sufficiently defoamed.

After defoaming, the remaining amount of the ion-exchanged water was added, and dispersed for 10 minutes at 5,000 rpm using a homogenizer (ULTRA-TURRAX (registered trademark) T50, manufactured by IKA Company), and then the mixture was stirred for one day and night with a stirrer and defoamed. After defoaming, the mixture was again dispersed at 6,000 rpm for 10 minutes using a homogenizer, and then stirred for one day and night with a stirrer and defoamed. Subsequently, the dispersion liquid was dispersed at a pressure of 240 MPa using a high pressure impact type dispersing machine Ultimizer (registered trademark) (manufactured by SUGINO MACHINE LIMITED., HJP 30006). The dispersion passed 25 times at a pressure of 240 MPa by conversion from the total charge amount and the processing capacity of the apparatus.

The obtained dispersion liquid was left for 72 hours to remove a precipitate, ion-exchanged water was added to adjust the solid content concentration to 15% by mass, and the resulting mixture was set as the cyan colorant particle dispersion liquid (Cy). The volume-based median diameter D50 of the colorant particles in the obtained dispersion liquid was 165 nm.

Production Example 6: Preparation of Magenta Colorant Particle Dispersion Liquid (Ma)

A magenta colorant particle dispersion liquid (Ma) was prepared in the same manner as in Production Example 5 except that the colorant was changed as follows;

Magenta pigment (C.I. Pigment Red 238): 200 parts by mass

For the obtained magenta colorant particle dispersion liquid (Ma), the volume-based median diameter of the colorant particles was 230 nm.

Production Example 7: Preparation of Yellow Colorant Particle Dispersion Liquid (Ye)

A yellow colorant particle dispersion liquid (Ye) was prepared in the same manner as in Production Example 5 except that the colorant was changed as follows;

Yellow pigment (C.I. Pigment Yellow 74): 200 parts by mass

For the obtained yellow colorant particle dispersion liquid (Ye), the volume-based median diameter of the colorant particles was 190 nm.

Production Example 8: Preparation of Black Colorant Particle Dispersion Liquid (Bk)

A black colorant particle dispersion liquid (Bk) was prepared in the same manner as in Production Example 5 except that the colorant was changed as follows;

Black pigment (carbon black): 200 parts by mass

For the obtained black colorant particle dispersion liquid (Bk), the volume-based median diameter of the colorant particles was 205 nm.

Production Example 9: Preparation of Aluminum Sulfate Aqueous Solution

Aluminum sulfate powder (17% aluminum sulfate, manufactured by Asada Chemical Industry Co., Ltd.): 35 parts by mass Ion-exchanged water: 1965 parts by mass The above components were charged into a 2 L container, and stirred and mixed at 30° C. until the precipitate disappeared, thereby preparing an aluminum sulfate aqueous solution.

<Production of Each Toner and Each Developer>

[Production of Cyan Toner (TC1)]

<Aggregation/Fusion Process and Aging Process>

Amorphous polyester resin particle dispersion liquid (DA1): 56 parts by mass (in terms of solid content)

Crystalline polyester resin particle dispersion liquid (DC1): 24 parts by mass (in terms of solid content)

Vinyl resin particle dispersion liquid (DV1): 20 parts by mass (in terms of solid content)

Cyan colorant particle dispersion liquid (Cy): 7 parts by mass (in terms of solid content)

Releasing agent particle dispersion liquid (DW1): 15 parts by mass (in terms of solid content)

Ion-exchanged water: 300 parts by mass

Anionic surfactant (Dowfax (registered trademark) 2A1, manufactured by The Dow Chemical Company): 6.5 parts by mass The above components were placed in a 3 L reaction vessel equipped with a thermometer, a pH meter and a stirrer, added with 0.3 M nitric acid at a temperature of 25° C. to adjust the pH to 3.0, and then dispersed by a homogenizer (ULTRA TURRAX (registered trademark) T50, manufactured by IKA Japan) at 5,000 rpm, and added with 130 parts by mass of the prepared aluminum sulfate aqueous solution and dispersed for 6 minutes.

Thereafter, a stirrer and a mantle heater were installed in the reaction vessel. While the number of revolutions of the stirrer was adjusted so that the slurry was sufficiently stirred, the temperature was raised at the temperature rising rate of 0.2° C./min up to the temperature of 40° C., and the temperature rising rate of 0.05° C./min after the temperature exceeded 40° C., and the particle diameter was measured every 10 minutes with Multisizer II (aperture diameter: 50 μm, manufactured by Beckman Coulter, Inc.).

When the volume-based median diameter reached 5.3 μm, the temperature was maintained and the pH was adjusted to 9.0 with a 4% by mass aqueous sodium hydroxide solution. Thereafter, the temperature was raised to 90° C. at a temperature rising rate of 1° C./min while similarly adjusting that the pH was 9.0 every 5° C., and the temperature was maintained at 90° C. Coalescence (fusion) of the particles was confirmed at 2.0 hours.

<Cooling Process>

Thereafter, the container was cooled with cooling water to 30° C. over 5 minutes.

<Filtering/Washing Process>

Next, the cooled slurry was passed through a nylon mesh having an aperture of 15 μm to remove coarse particles. Nitric acid was added to the toner slurry that passed through the mesh to adjust the pH to 6.0. Thereafter, the mixture was filtered under reduced pressure with an aspirator. The toner cake remaining on the filter paper was crushed as finely as possible with hand, added at 30° C. to ion-exchanged water having an amount 10 times larger than that of the toner, and then stirred and mixed for 30 minutes. Thereafter, the mixture was filtered under reduced pressure again using an aspirator, and the electrical conductivity of the filtrate was measured. The above operation (washing operation) was repeated until the electrical conductivity of the filtrate became 10 S/cm or less, and the toner base particles were washed.

<Drying Process>

The washed toner base particles were finely crushed with a wet type dry type sizing machine (Comil) and vacuum-dried in an oven at 35° C. for 36 hours to obtain toner base particles.

<External Additive Addition Process>

To 100 parts by mass of the obtained toner base particles, 1.0 part by mass of hydrophobic silica (manufactured by Nippon Aerosil Co., Ltd., Aerosil (registered trademark) RY50) was added and mixed for 30 seconds using a sample mill at 13,000 rpm. Thereafter, the mixture was sieved with a vibrating sieve having an aperture of 45 μm to obtain a cyan toner (TC1).

Toner particles of the obtained cyan toner (TC1) had a volume-based median diameter D50 of 5.5 μm, a CV value of 19%, and an average circularity of 0.964. Further, the median diameter and the CV value were measured using a Coulter Multisizer II type (manufactured by Beckman Coulter, Inc.) measuring apparatus, and "ISOTON (registered trademark) II" (manufactured by Beckman Coulter, Inc.) was used as the electrolyte. In addition, the circularity was measured using FPIA-3000 (manufactured by Sysmex Corporation). A toner particle dispersion liquid for measurement was prepared as follows. First, 30 mL of ion-exchanged water was placed in a 100 mL beaker, and two drops of a surfactant as a dispersant were added thereto. In this liquid, 20 mg of the toner particles was placed and dispersed by ultrasonic dispersion for 3 minutes to prepare dispersion liquid. With respect to the obtained toner particle dispersion liquid, 4500 particles were measured using the FPIA-3000, and the average circularity was calculated.

[Production of Cyan Toner (TC2)]

A cyan toner (TC2) was prepared in the same manner as in the above cyan toner (TC1) except that the added amount (unit: part by mass) of each resin was changed to the value shown in Table 1.

[Production of Magenta Toners (TM1) to (TM2)]

The magenta toners (TM1) to (TM2) were prepared, respectively, in the same manner as in the above cyan toner (TC1) except that the colorant particle dispersion liquid was changed to the magenta colorant particle dispersion liquid (Ma) and the added amount (unit: part by mass) of each resin was changed to the value shown in Table 1.

[Production of Yellow Toners (TY1) to (TY2)]

The yellow toners (TY1) to (TY2) were prepared, respectively, in the same manner as in the above cyan toner (TC1) except that the colorant particle dispersion liquid was changed to the yellow colorant particle dispersion liquid (Ye) and the added amount (unit: part by mass) of each resin was changed to the value shown in Table 1.

[Production of Black Toners (TK1) to (TK10)]

The black toners (TK1) to (TK10) were prepared, respectively, in the similar manner as in the above cyan toner (TC1) except that the colorant particle dispersion liquid was changed to the black colorant particle dispersion liquid (Bk) and the added amount (unit: part by mass) of each resin was changed to the value shown in Table 1.

[Preparation of Cyan Developer (VC1)]

To the cyan toner (TC1), a ferrite carrier coated with an acrylic resin and having a volume average particle diameter of 60 μm was added and mixed so that the toner particle concentration reached 6% by mass, thereby obtaining the developer (VC1).

[Preparation of Cyan Developer (VC2), Magenta Developers (VM1) to (VM2), Yellow Developers (VY1) to (VY2) and Black Developers (VK1) to (VK10)]

The cyan developer (VC2), magenta developers (VM1) to (VM2), yellow developers (VY1) to (VY2) and black developers (VK1) to (VK10) were prepared, respectively, in the similar manner as in the above cyan developer (VC1) except that the used toner was changed to the cyan toner (TC2), magenta toners (TM1) to (TM2), yellow toners (TY1) to (TY2) and black toners (TK1) to (TK10).

TABLE 1

| | | | | | Binder Resin | | | | | | | | | | | | | | | | | |
|---|---|---|---|---|---|---|---|---|---|---|---|---|---|---|---|---|---|---|---|---|---|---|
| | | | | | Content of amorphous polyester resin | | | | Content of crystalline polyester resin | | | | Content of vinyl resin | | | | Releasing agent Content of releasing agent | | | | Vk- | Wc- |
| | Y | M | C | K | Y | M | C | K | Y | M | C | K | Y | M | C | K | Y | M | C | K | Vc | Wk |
| Example 1 | TY1 | TM1 | TC1 | TK1 | 56 | 56 | 56 | 45.5 | 24 | 24 | 24 | 19.5 | 20 | 20 | 20 | 35 | 15 | 15 | 15 | 12 | 15 | 3 |
| Example 2 | TY1 | TM1 | TC1 | TK2 | 56 | 56 | 56 | 45.5 | 24 | 24 | 24 | 19.5 | 20 | 20 | 20 | 35 | 15 | 15 | 15 | 10 | 15 | 5 |
| Example 3 | TY1 | TM1 | TC1 | TK3 | 56 | 56 | 56 | 45.5 | 24 | 24 | 24 | 19.5 | 20 | 20 | 20 | 35 | 15 | 15 | 15 | 6 | 15 | 9 |
| Example 4 | TY1 | TM1 | TC1 | TK4 | 56 | 56 | 56 | 52.5 | 24 | 24 | 24 | 22.5 | 20 | 20 | 20 | 25 | 15 | 15 | 15 | 10 | 5 | 5 |
| Example 5 | TY1 | TM1 | TC1 | TK5 | 56 | 56 | 56 | 35 | 24 | 24 | 24 | 15 | 20 | 20 | 20 | 50 | 15 | 15 | 15 | 10 | 30 | 5 |
| Example 6 | TY2 | TM2 | TC2 | TK6 | 80 | 80 | 80 | 65 | 0 | 0 | 0 | 0 | 20 | 20 | 20 | 35 | 15 | 15 | 15 | 10 | 15 | 5 |
| Comparative Example 1 | TY1 | TM1 | TC1 | TK7 | 56 | 56 | 56 | 45.5 | 24 | 24 | 24 | 19.5 | 20 | 20 | 20 | 35 | 15 | 15 | 15 | 14 | 15 | 1 |
| Comparative Example 2 | TY1 | TM1 | TC1 | TK8 | 56 | 56 | 56 | 45.5 | 24 | 24 | 24 | 19.5 | 20 | 20 | 20 | 35 | 15 | 15 | 15 | 3 | 15 | 12 |
| Comparative Example 3 | TY1 | TM1 | TC1 | TK9 | 56 | 56 | 56 | 55.3 | 24 | 24 | 24 | 23.7 | 20 | 20 | 20 | 21 | 15 | 15 | 15 | 10 | 1 | 5 |
| Comparative Example 4 | TY1 | TM1 | TC1 | TK10 | 56 | 56 | 56 | 21 | 24 | 24 | 24 | 9 | 20 | 20 | 20 | 70 | 15 | 15 | 15 | 10 | 50 | 5 |

Y: Yellow,
M: Magenta,
C: Cyan,
K: Black
As for the content of each resin and releasing agent, the unit is part by mass.

<Evaluation>

Using the developer prepared above, each combination (developer set) shown in Table 1 above was evaluated.

[Glossiness]

In a full-color copying machine "bizhub PRO (registered trademark) C1100" (manufactured by KONICA MINOLTA, INC.), a commercial composite printer, a solid image having a toner adhesion amount of 4 g/m$^2$ was output on "POD 128 g gloss coating (128 g/m$^2$)" (manufactured by Oji Paper Co., Ltd.) under the environment of 20° C. and 50% RH, and the glossiness of the solid image was measured. The glossiness was determined by measuring glossiness at three points in the axial direction of the photoreceptor using micro-gloss (75°) manufactured by BYK Gardner, and averaging these values to calculate the glossiness (unit: %) of each image. Then, a difference between the glossiness of the image formed by the black toner and the glossiness of the image formed by the color toner other than the black toner was calculated, thereby obtaining "gloss difference". The gloss difference is judged to be acceptable if it is in the range of 5 to 35%, more preferably in the range of 10 to 25%. The obtained results were ranked according to the following evaluation criteria.

—Evaluation Criteria—

A: gloss difference between the black toner and the color toner is 10 to 25%.

B: gloss difference between the black toner and the color toner is 5 to 35% (however, it does not correspond to the above A)

C: gloss difference between the black toner and the color toner is less than 5% or more than 35%.

[Charge Amount]

With a full-color copying machine "bizhub PRO (registered trademark) C1100" (manufactured by KONICA MINOLTA, INC.), a commercial composite printer, 10,000 sheets of evaluation charts with a printing ratio of 5% were continuously printed out at a printing speed of 100 sheets per minute in A4 long edge feed under the environment of 20° C. and 50% RH. The charge amount of the developer before printing ("initial" in Table 2) and the charge amount of the developer after printing 10,000 sheets ("after printing" in Table 2) were measured. Also, a difference between the initial charge amount and the charge amount after printing was obtained for each color, and a difference between the reduction of the charge amount of the black toner and the reduction of the charge amount of the color toner other than the black toner was obtained. Results thereof were shown in Table 2. It is preferable that the difference between the reductions is as small as possible, and if it is 10 μC/g or less, it is judged to be acceptable. The obtained results were ranked according to the following evaluation criteria.

—Evaluation Criteria—

A: the difference between the reduction of the charge amount of the black toner and the reduction of the charge amount of the color toner is 3 μC/g or less B: the difference between the reduction of the charge amount of the black toner and the reduction of the charge amount of the color toner is more than 3 μC/g and 9 μC/g or less C: the difference between the reduction of the charge amount of the black toner and the reduction of the charge amount of the color toner is more than 9 μC/g and 10 μC/g or less D: the difference between the reduction of the charge amount of the black toner and the reduction of the charge amount of the color toner is more than 10 μC/g The charge amount of the toner was measured using the apparatus shown in FIGURE. First, 1 g of the developer weighed with a precision balance was placed on the entire surface of a conductive sleeve (31) so as to be uniform. A voltage of 2 kV was supplied from a bias power source (33) to the conductive sleeve (31) and the number of revolutions of a magnet roll (32) provided in the conductive sleeve (31) was set to 1000 rpm. In this state, the toner was left for 30 seconds, and the toner was collected on the cylindrical electrode (34). After 30 seconds, the potential Vm of the cylindrical electrode (34) was read, the charge amount of the toner was obtained, and the mass of the collected toner was measured with a precision balance to obtain an average charge amount (unit: μC/g).

The results obtained by the above evaluations are shown in the following Table 2. In addition, the softening points of the respective toners measured according to the above procedure are also shown in Table 2 below.

TABLE 2

| | Toner | Softening Point (° C.) | Glossiness (%) | Gloss difference (%) | Charge amount (μC/g) Initial | After printing | Reduction | Difference in reduction |
|---|---|---|---|---|---|---|---|---|
| Example 1 | TY1 | 101 | 50 | 7(B) | 50 | 35 | 15 | 1(A) |
| | TM1 | 102 | 50 | | 50 | 35 | 15 | |
| | TC1 | 102 | 50 | | 50 | 35 | 15 | |
| | TK1 | 108 | 43 | | 50 | 34 | 16 | |
| Example 2 | TY1 | 101 | 50 | 15(A) | 50 | 35 | 15 | 2(A) |
| | TM1 | 102 | 50 | | 50 | 35 | 15 | |
| | TC1 | 102 | 50 | | 50 | 35 | 15 | |
| | TK2 | 110 | 35 | | 50 | 37 | 13 | |
| Example 3 | TY1 | 101 | 50 | 25(A) | 50 | 35 | 15 | 8(B) |
| | TM1 | 102 | 50 | | 50 | 35 | 15 | |
| | TC1 | 102 | 50 | | 50 | 35 | 15 | |
| | TK3 | 114 | 25 | | 50 | 43 | 7 | |
| Example 4 | TY1 | 101 | 50 | 5(B) | 50 | 35 | 15 | 8(B) |
| | TM1 | 102 | 50 | | 50 | 35 | 15 | |
| | TC1 | 102 | 50 | | 50 | 35 | 15 | |
| | TK4 | 105 | 45 | | 54 | 47 | 7 | |
| Example 5 | TY1 | 101 | 50 | 34(B) | 50 | 35 | 15 | 10(C) |
| | TM1 | 102 | 50 | | 50 | 35 | 15 | |
| | TC1 | 102 | 50 | | 50 | 35 | 15 | |
| | TK5 | 116 | 16 | | 45 | 40 | 5 | |
| Example 6 | TY2 | 115 | 15 | 5(B) | 55 | 30 | 25 | 10(C) |
| | TM2 | 114 | 15 | | 55 | 30 | 25 | |
| | TC2 | 115 | 15 | | 55 | 30 | 25 | |
| | TK6 | 120 | 10 | | 55 | 40 | 15 | |
| Comparative Example 1 | TY1 | 101 | 50 | 2(C) | 50 | 35 | 15 | 5(B) |
| | TM1 | 102 | 50 | | 50 | 35 | 15 | |
| | TC1 | 102 | 50 | | 50 | 35 | 15 | |
| | TK7 | 104 | 48 | | 50 | 40 | 10 | |
| Comparative Example 2 | TY1 | 101 | 50 | 38(C) | 50 | 35 | 15 | 12(D) |
| | TM1 | 102 | 50 | | 50 | 35 | 15 | |
| | TC1 | 102 | 50 | | 50 | 35 | 15 | |
| | TK8 | 118 | 12 | | 50 | 47 | 3 | |
| Comparative Example 3 | TY1 | 101 | 50 | 3(C) | 50 | 35 | 15 | 12(D) |
| | TM1 | 102 | 50 | | 50 | 35 | 15 | |
| | TC1 | 102 | 50 | | 50 | 35 | 15 | |
| | TK9 | 104 | 47 | | 50 | 47 | 3 | |
| Comparative Example 4 | TY1 | 101 | 50 | 45(C) | 50 | 35 | 15 | 15(D) |
| | TM1 | 102 | 50 | | 50 | 35 | 15 | |
| | TC1 | 102 | 50 | | 50 | 35 | 15 | |
| | TK10 | 125 | 5 | | 40 | 40 | 0 | |

* Regarding the charge amount, the "difference in reduction" indicates an absolute value.

From the results shown in Table 2, according to the toner (developer) set (or image forming method) of Examples 1 to 6, the difference in gloss between the black portion and the color portion was within the suitable range, and good results were also obtained for the reduction in charge amount at the time of continuous printing. Therefore, according to the constitution of the present invention, it can be noted that the balance of the gloss of the black portion and the color portion can be improved and the image quality at the time of continuous printing can be maintained favorably. Further, among the Examples, Example 2 obtained the most balanced results regarding the balance of gloss and the image quality at the time of continuous printing. Then, Examples 1, 3 and 4 also obtained good results.

Meanwhile, in the toner (developer) set (or image forming method) of Comparative Examples 1 to 4, the balance of gloss was not good in the formed image. Further, in the toner (developer) set (or image forming method) of Comparative Examples 2 to 4, the image quality at the time of continuous printing was deteriorated.

Although the embodiments of the present invention have been described in detail, they are intended to be illustrative and not restrictive, and it is obvious that the scope of the present invention should be interpreted by the appended claims. Further, the embodiments of the present invention are not limited to the above-described embodiments, and may be modified as needed within the scope of the present invention.

What is claimed is:

1. In an image forming method using a black toner and a color toner other than the black toner, comprising: developing an electrostatic latent image with a black toner and a color toner other than the black toner; transferring a developed image of the black toner and the color toner onto an image support; and fixing a transferred image of the black toner and the color toner on the image support to provide a visible image, wherein the improvement comprises the black toner and the color toner each comprise a binder resin including a polyester resin being a combination of an amorphous polyester resin and a crystalline polyester resin as a main component and a vinyl resin, a releasing agent, and an external additive, and the following formula (1) and formula (2) are satisfied wherein Vk % by mass is a content of the vinyl resin relative to total mass of the binder resin included in the black toner, Vc % by mass is a content of the vinyl resin relative to total mass of the binder resin included in the color toner, Wk % by mass is a content of the releasing agent relative to the total mass of the binder resin included in the black toner, and Wc % by mass is a content of the releasing agent relative to the total mass of the binder resin included in the color toner:

$$2<Vk-Vc<50 \quad (1)$$

$$2<Wc-Wk<10 \quad (2),$$

the Vk is 20 to 50% by mass, and the Vc is from 10 to 30% by mass, and the Wk is 3 to 20% by mass, and the Wc is more than 5% by mass and less than 30% by mass, wherein a mass ratio of the amorphous polyester resin to the crystalline polyester resin is 60/40 to 90/10, and wherein the black toner and the color toner each exhibit a difference in charge reduction relative to each other of 9 μC/g or less, the charge reduction being the difference in charge amount for each toner measured at initial printing and measured after printing 10,000 sheets.

2. The image forming method as claimed in claim 1, wherein the Vk and the Vc further satisfy the following formula (3):

$$10<Vk-Vc<30 \quad (3).$$

3. The image forming method as claimed in claim 1, wherein the Wk and the Wc further satisfy the following formula (4):

$$3<Wc-Wk<8 \quad (4).$$

4. The image forming method as claimed in claim 1, wherein a softening point of the black toner is higher than a softening point of the color toner.

5. A toner set for developing an electrostatic latent image, comprising: a black toner; and a color toner other than the black toner, wherein the black toner and the color toner each comprise a binder resin including a polyester resin being a combination of amorphous polyester resin and crystalline polyester resin as a main component and a vinyl resin, a releasing agent, and an external additive, and the following formula (1) and formula (2) are satisfied wherein Vk % by mass is a content of the vinyl resin relative to total mass of the binder resin included in the black toner, Vc % by mass is a content of the vinyl resin relative to total mass of the binder resin included in the color toner, Wk % by mass is a content of the releasing agent relative to the total mass of the binder resin included in the black toner, and Wc % by mass is a content of the releasing agent relative to the total mass of the binder resin included in the color toner:

$$2<Vk-Vc<50 \quad (1)$$

$$2<Wc-Wk<10 \quad (2),$$

the Vk is 20 to 50% by mass, and the Vc is from 10 to 30% by mass, and the Wk is 3 to 20% by mass, and the We is more than 5% by mass and less than 30% by mass, wherein a mass ratio of the amorphous polyester resin to the crystalline polyester resin is 60/40 to 90/10, and wherein the black toner and the color toner each exhibit a difference in charge reduction relative to each other of 9 μC/g or less, the charge reduction being the difference in charge amount for each toner measured at initial printing and measured after printing 10,000 sheets.

* * * * *